US010391801B2

(12) United States Patent
Noguchi et al.

(10) Patent No.: US 10,391,801 B2
(45) Date of Patent: Aug. 27, 2019

(54) INKJET RECORDING METHOD AND INKJET RECORDING APPARATUS

(71) Applicant: CANON KABUSHIKI KAISHA, Tokyo (JP)

(72) Inventors: Mitsutoshi Noguchi, Kawaguchi (JP); Ryosuke Hirokawa, Kawasaki (JP); Toru Ohnishi, Yokohama (JP); Shingo Okushima, Kawasaki (JP); Yoichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,121

(22) Filed: Jun. 29, 2018

(65) Prior Publication Data

US 2019/0009599 A1 Jan. 10, 2019

(30) Foreign Application Priority Data

Jul. 4, 2017 (JP) ..... 2017-131375

(51) Int. Cl.

| | |
|---|---|
| ***B41J 2/18*** | (2006.01) |
| ***B41M 5/00*** | (2006.01) |
| ***B41J 2/01*** | (2006.01) |

(52) U.S. Cl.

CPC ..... *B41M 5/0011* (2013.01); *B41J 2/01* (2013.01); *B41J 2/18* (2013.01); *B41J 2202/12* (2013.01)

(58) Field of Classification Search

CPC . B41J 2/18; B41J 2/01; B41J 2202/12; B41M 5/0011

See application file for complete search history.

(56) References Cited

U.S. PATENT DOCUMENTS

| | | | |
|---|---|---|---|
| 5,100,468 | A | 3/1992 | Yuasa et al. |
| 6,582,070 | B2 | 6/2003 | Takada et al. |
| 7,291,214 | B2 | 11/2007 | Tsuji et al. |
| 7,297,203 | B2 | 11/2007 | Takada et al. |
| 7,559,632 | B2 | 7/2009 | Kodama |

(Continued)

FOREIGN PATENT DOCUMENTS

| | | | |
|---|---|---|---|
| JP | 2007-118309 | A | 5/2007 |
| JP | 2009-045851 | A | 3/2009 |
| WO | 2011/146069 | A1 | 11/2011 |

OTHER PUBLICATIONS

Nov. 19, 2018 extended European Search Report in European Patent Appln. No. 18181344.5.

*Primary Examiner* — Lamson D Nguyen
(74) *Attorney, Agent, or Firm* — Venable LLP

(57) ABSTRACT

An inkjet recording method of the present invention comprises forming an ink image by ejecting ink on an ejection receiving medium by an inkjet head including a recording element substrate having an energy generation element, a pressure chamber, and an ejection port, wherein the ink is circulated between the inside of the pressure chamber and the outside of the pressure chamber; and removing at least a portion of a liquid component from the ink image by bringing a liquid absorbing member into contact with the ink image, wherein the ink contains 5 to 30 mass % of a water-soluble organic solvent having a bp of 110° C. or more, and 50 mass % or more of the water-soluble organic solvent contained in the ink image and having a bp of 110° C. or more is removed from the ink image in the removal of at least a portion of a liquid component from the ink image.

10 Claims, 11 Drawing Sheets

(56) References Cited

U.S. PATENT DOCUMENTS

| | | | | |
|---|---|---|---|---|
| 9,090,789 | B2 | 7/2015 | Hakamada et al. | |
| 2009/0244235 | A1 | 10/2009 | Houjou | |
| 2009/0317555 | A1* | 12/2009 | Hori ..... | B41J 2/0057 427/428.06 |
| 2010/0021635 | A1 | 1/2010 | Ookawa et al. | |
| 2010/0091055 | A1 | 4/2010 | Kawakami et al. | |
| 2017/0217217 | A1 | 8/2017 | Miyakoshi et al. | |
| 2017/0232729 | A1 | 8/2017 | Hirokawa et al. | |
| 2017/0232762 | A1 | 8/2017 | Hirokawa et al. | |

* cited by examiner

INKJET RECORDING METHOD AND INKJET RECORDING APPARATUS

BACKGROUND OF THE INVENTION

Field of the Invention

The present invention relates to an inkjet recording method and an inkjet recording apparatus.

Description of the Related Art

In an inkjet recording system, an image is formed by directly applying a liquid composition (ink) containing a color material onto a recording medium such as paper. In this operation, curl or cockling may occur due to the excessive absorption of a liquid component in the ink by the recording medium.

Accordingly, a method for rapidly removing a liquid component in ink involves drying a recording medium using a unit such as warm air or infrared ray or involves forming an ink image on a transfer member, then drying a liquid component contained in the ink image on the transfer member using thermal energy or the like, and then transferring the ink image to a recording medium such as paper.

A method which involves absorbing and removing a liquid component from an ink image by bringing a roller-shaped porous body into contact with the ink image without the use of thermal energy has been further proposed as a unit of removing a liquid component contained in the ink image on a transfer member (Japanese Patent Application Laid-Open No. 2009-45851).

Meanwhile, in the ejection of an ink by an inkjet head, a liquid component such as water in the ink may be evaporated, the ink may be thickened, and the concentration of a color material may change due to heat generated along with ejecting operation, heat due to the temperature control of a record element substrate, and the heat from the external environment near an ejection port. Therefore, for example, Japanese Patent Application Laid-Open No. 2007-118309 discloses performing the ejecting operation of ink while circulating the ink through a flow channel between the ejection port of an inkjet head and an element (energy generation element) generating energy used to eject the ink. Therefore, ink which is thickened and the concentration of a color material of which is changed can be ejected, and new ink can be supplied. Hence, ejection failure due to the thickening of the ink and the color irregularity of an image due to change in the concentration of the color material can be suppressed.

SUMMARY OF THE INVENTION

The present invention is directed to providing an inkjet recording method and an inkjet recording apparatus enabling suppressing decreases in image quality and image stability also when ink in the pressure chamber of an inkjet head is circulated between the inside and the outside of a pressure chamber.

According to one aspect of the present invention, provided is an inkjet recording method having:

forming an ink image by ejecting ink on an ejection receiving medium by an inkjet head including a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber; and removing at least a portion of a liquid component from the ink image by bringing a liquid absorbing member into contact with the ink image, wherein the ink contains 5 to 30% by mass of a water-soluble organic solvent having a boiling point of 110° C. or more, and 50% by mass or more of the water-soluble organic solvent contained in the ink image and having a boiling point of 110° C. or more is removed from the ink image in the removal of at least a portion of a liquid component from the ink image.

According to another aspect of the present invention, provided is an inkjet recording apparatus including:

an ejection receiving medium;

an ink application apparatus having an inkjet head including a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber, and an ink image is formed by ejecting the ink on the ejection receiving medium; and a liquid absorption apparatus having a liquid absorbing member which removes at least a portion of a liquid component from the ink image by coming into contact with the ink image, wherein the ink contains 5 to 30% by mass of a water-soluble organic solvent having a boiling point of 110° C. or more, and 50% by mass or more of the water-soluble organic solvent contained in the ink image and having a boiling point of 110° C. or more is removed from the ink image by bringing the liquid absorbing member into contact with the ink image.

Further features of the present invention will become apparent from the following description of exemplary embodiments with reference to the attached drawings.

DESCRIPTION OF THE EMBODIMENTS

Figure 1:
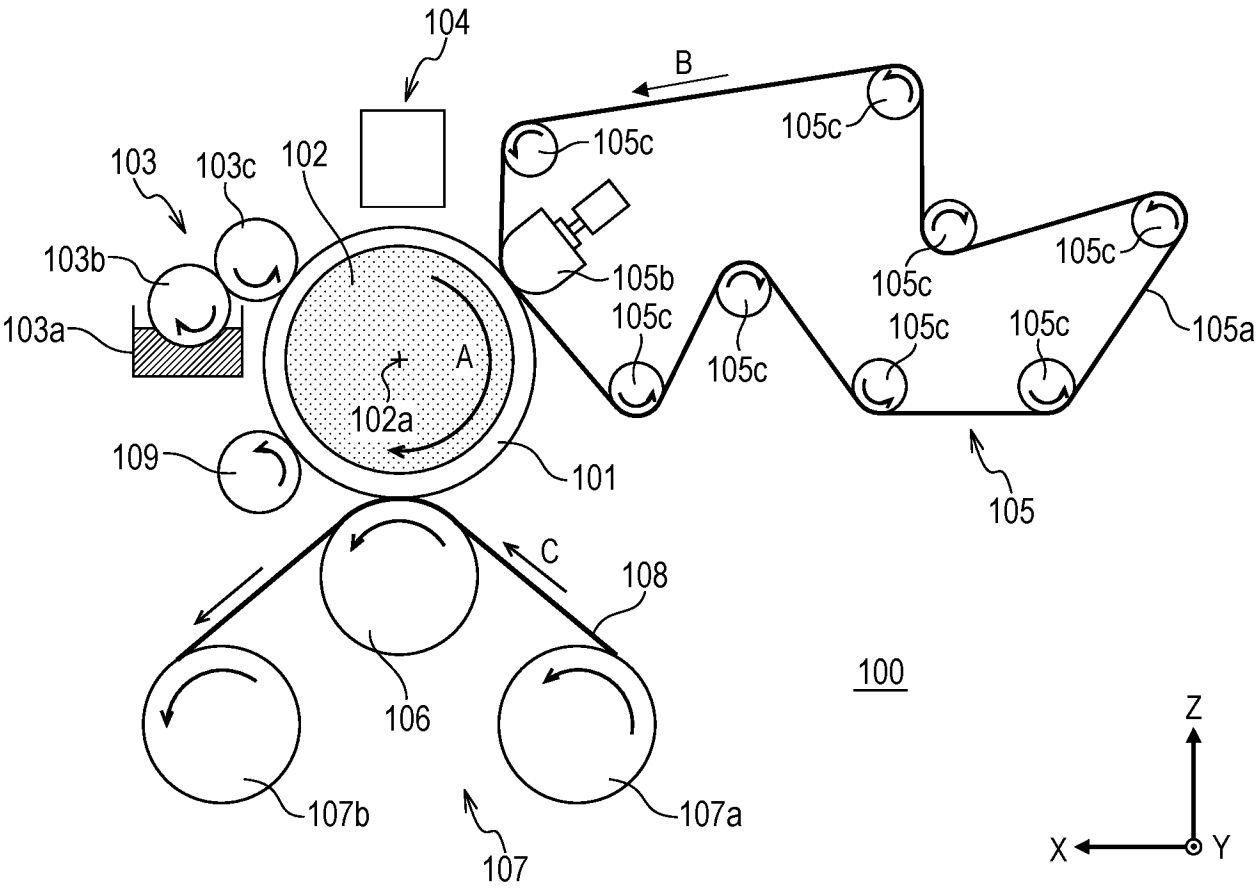
FIG. 1 is a schematic view illustrating one example of the configuration of a transfer-type inkjet recording apparatus according to one embodiment of the present invention.

Preferred embodiments of the present invention will now be described in detail in accordance with the accompanying drawings.

In a technique described in Japanese Patent Application Laid-Open No. 2007-118309, a problem that the evaporation of water in the ink from an ejection port is promoted by circulating ink in a flow channel and the concentration of the ink increases easily is present. Ink may contain a water-soluble organic solvent having a high boiling point to improve ejection stability, and the proportion of nonvolatile components in the ejected ink tends to increase due to the above-mentioned promotion of the evaporation of water in this case. Consequently, a problem that the proportion of the nonvolatile components in the final image becomes high and the image quality and image stability of the final image are reduced by the nonvolatile components is present.

An inkjet recording method according to the present invention has: forming an ink image by ejecting ink on an ejection receiving medium by an inkjet head including a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber; and removing at least a portion of a liquid component from the ink image by bringing a liquid absorbing member into contact with the ink image. Here, the ink contains 5 to 30% by mass of a water-soluble organic solvent having a boiling point of 110° C. or more. Further, 50% by mass or more of the water-soluble organic solvent contained in the ink image and having a boiling point of 110° C. or more is removed from the ink image in the removal of at least a portion of a liquid component from the ink image.

The inkjet recording apparatus according to the present invention includes the following configuration: an ejection receiving medium; an ink application apparatus having an inkjet head including a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber, and an ink image is formed by ejecting the ink on the ejection receiving medium; and a liquid absorption apparatus having a liquid absorbing member which removes at least a portion of a liquid component from the ink image by coming into contact with the ink image. Here, the ink contains 5 to 30% by mass of a water-soluble organic solvent having a boiling point of 110° C. or more. Further, 50% by mass or more of the water-soluble organic solvent contained in the ink image and having a boiling point of 110° C. or more is removed from the ink image by bringing the liquid absorbing member into contact with the ink image.

Ink which is thickened and the concentration of a color material of which is changed by evaporation of water and the like due to the above-mentioned heat can be ejected, and new ink can be supplied by performing the ejecting operation of an ink while circulating the ink in the inkjet head. However, when an inkjet head is used for a long time, the same ink is circulated. Therefore, the concentration of the circulated ink tends to increase gradually by the gradual evaporation of water and an organic solvent having a low boiling point. Therefore, the rate of the nonvolatile components in the ink ejected from the inkjet head increases. Especially when the ink contains the water-soluble organic solvent having 110° C. or more (also called an organic solvent having a high boiling point), the water-soluble organic solvent has low volatility, and is difficult to remove by drying methods such as ventilation and heating. Therefore, the water-soluble organic solvent hardly evaporates under a usual environment (environment of normal temperature and normal humidity) when the content of the water-soluble organic solvent in the obtained images (an ink image) is high. Hence, the image quality may decrease, or image quality may change over time due to influence such as movement of the water-soluble organic solvent in the images and the permeation of the water-soluble organic solvent into a recording medium.

In the present invention, images are formed using an ink containing 5 to 30% by mass of a water-soluble organic solvent having a boiling point of 110° C. or more. When a liquid component is removed by bringing a liquid absorbing member having a porous body into contact with the ink image on an ejection receiving medium formed using the ink at this time, 50% by mass or more of the water-soluble organic solvent contained in the ink image and having a boiling point of 110° C. or more is removed. Therefore, the water-soluble organic solvent having a boiling point of 110° C. or more and removed difficultly in a drying method using warm air or infrared rays can be removed at a temperature of the boiling point thereof or less. Since the content of the water-soluble organic solvent in the ink image having a boiling point of 110° C. or more is reduced, decreases in the image quality and image stability of the obtained images can be suppressed.

Hereinafter, an inkjet recording apparatus according to an embodiment of the present invention will be described with reference to the drawings.

Examples of the inkjet recording apparatus of the present embodiment include: an inkjet recording apparatus configured such that ink is ejected onto a transfer member as an ejection receiving medium to form an ink image, which is then subjected to liquid absorption by a liquid absorbing member, followed by the transfer of the ink image to a recording medium; and an inkjet recording apparatus configured such that an ink image is formed on a recording medium such as paper or cloth as an ejection receiving medium, followed by liquid absorption from the ink image on the recording medium by a liquid absorbing member. In the present invention, the former inkjet recording apparatus is referred to as a transfer-type inkjet recording apparatus below for the sake of convenience. The latter inkjet recording apparatus is referred to as a direct writing-type inkjet recording apparatus below for the sake of convenience.

Hereinafter, each type of the inkjet recording apparatus will be described.

[Transfer-Type Inkjet Recording Apparatus]

FIG. 1 is a schematic view illustrating one example of the configuration outline of transfer-type inkjet recording apparatus 100 of the present embodiment. This recording apparatus is a sheet-fed inkjet recording apparatus producing a recorded article by transferring an ink image to recording medium 108 via transfer member 101. In the present embodiment, the X direction, the Y direction and the Z direction refer to the width direction (lengthwise direction), the depth direction and the height direction, respectively, of the inkjet recording apparatus 100. The recording medium 108 is transported in the X direction.

Transfer-type inkjet recording apparatus 100 of the present invention has: transfer member 101 supported by supporting member 102; reaction solution application apparatus 103 for applying a reaction solution that is reacted with color ink to the transfer member 101; ink application apparatus 104 including an inkjet head for applying color ink to the transfer member 101 to which the reaction solution is applied and forming an ink image, which are images by the ink, on the transfer member; liquid absorption apparatus 105 for absorbing a liquid component from the ink image on the transfer member; and pressing member 106 for transferring the ink image on the transfer member from which the liquid component is removed to recording medium 108 such as paper as illustrated in FIG. 1. The transfer-type inkjet recording apparatus 100 may have, if necessary, transfer member cleaning member 109 which cleans the surface of the transfer member 101 after transfer. As a matter of course, the transfer member 101, the reaction solution application apparatus 103, the inkjet head of the ink application apparatus 104, the liquid absorption apparatus 105 and the transfer member cleaning member 109 each have a length sufficiently adaptable to the recording medium 108 used, in the Y direction.

The transfer member 101 rotates around rotational axis 102*a* of the supporting member 102 in a direction indicated by arrow A of FIG. 1. The transfer member 101 moves by this rotation of the supporting member 102. A reaction solution and ink are sequentially applied onto the moving transfer member 101 by the reaction solution application apparatus 103 and the ink application apparatus 104, respectively, to form an ink image on the transfer member 101. The ink image formed on the transfer member 101 is allowed, by the movement of the transfer member 101, to move to a position at which the ink image comes into contact with the liquid absorbing member 105*a* of the liquid absorption apparatus 105.

The transfer member 101 and the liquid absorption apparatus 105 move in synchronization with the rotation of the transfer member 101. The ink image formed on the transfer member 101 undergoes contact with this moving liquid absorbing member 105*a*. During this contact, the liquid absorbing member 105*a* removes a liquid component from the ink image on the transfer member. In this contacted state, particularly, the liquid absorbing member 105*a* can be pressed with predetermined pressing force against the transfer member 101 to thereby allow the liquid absorbing member 105*a* to function effectively.

The removal of the liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

Then, the liquid component-removed ink image after the liquid removal becomes an ink-concentrated state as compared with the ink image before the liquid removal and is further allowed by the transfer member 101 to move to transfer part in contact with recording medium 108 transported by recording medium transport apparatus 107. While the ink image after the liquid removal is in contact with the recording medium 108, the pressing member 106 for transfer presses the transfer member 101 so that the ink image is transferred onto the recording medium 108. The ink image thus transferred onto the recording medium 108 is a reverse image of the ink image before the liquid removal and the ink image after the liquid removal.

In the present embodiment, the reaction solution unreacted with ink remains in a non-image region where no ink image is formed with the ink, because an ink image is formed on the transfer member after application of the reaction solution and then the ink. In this apparatus, the liquid absorbing member 105*a* removes a liquid component of the reaction solution not only from the ink image but from the unreacted reaction solution by contact.

Thus, the phrase "liquid component is removed from the ink image" described above does not restrictively mean that the liquid component is removed only from the ink image, and is used to mean that the liquid component can be removed at least from the ink image on the transfer member.

The liquid component is not particularly limited as long as the liquid component has fluidity and has an almost constant volume without having a given shape.

Examples of the liquid component include water and an organic solvent contained in the ink or the reaction solution.

Each configuration of the transfer-type inkjet recording apparatus of the present embodiment will be described below.

<Transfer Member>

The transfer member 101 has a surface layer including an ink image forming face. Various materials such as resins and ceramics can be appropriately used as a material of the surface layer, and a material having a high compressive modulus of elasticity can be used in terms of durability, etc. Specific examples thereof include acrylic resin, acrylic silicone resin, fluorine-containing resin, and condensates obtained by condensing a hydrolyzable organosilicon compound. The material used may be surface-treated in order to improve the wettability of the reaction solution, transferability, etc. Examples of the surface treatment include frame treatment, corona treatment, plasma treatment, polishing treatment, roughening treatment, active energy line irradiation treatment, ozone treatment, surfactant treatment and silane coupling treatment. A plurality of these treatments may be combined. Also, the surface layer may be provided with an arbitrary surface shape.

As the material of the surface layer, condensates of hydrolyzable organosilicon compounds are preferable from the aspect of image quality and transferability. Additionally, condensates of hydrolyzable organosilicon compounds having a polymerization structure by cationic polymerization, radical polymerization or the like is more preferable from the aspect of durability. It is supposed that the components applied by the ink constituting an ink image effectively spread on an ink image formation surface which the surface layer has since the surface layer has a molecular structure including siloxane bonds derived from a hydrolyzable organosilicon compound. It is supposed that the exfoliation of an ink image from the transfer member becomes easy, resulting in improvement in transferability.

Specific examples of the hydrolyzable organosilicon compound include the following compounds, but the present invention is not limited to these compounds. For example, the compounds are glycidoxypropyltrimethoxysilane, glycidoxypropyltriethoxysilane, glycidoxypropylmethyldimethoxysilane, glycidoxypropylmethyldiethoxysilane, glycidoxypropyldimethylmethoxysilane, glycidoxypropyldimethylethoxysilane, 2-(epoxycyclohexyl)ethyltrimethoxysilane, 2-(epoxycyclohexyl)ethyltriethoxysilane, compounds in which the epoxy groups of these compounds are replaced with oxetanyl groups, acryloxypropyltrimethoxysilane acryloxypropyltriethoxysilane, acryloxypropylmethyldimethoxysilane, acryloxypropylmethyldiethoxysilane, acryloxypropyldimethylmethoxysilane, acryloxypropyldimethylethoxysilane, methacryloxypropyltrimethoxysilane, methacryloxypropyltriethoxysilane, methacryloxypropylmethyldimethoxysilane, methacryloxypropylmethyldiethoxysilane, methacryloxypropyldimethylmethoxysilane, methacryloxypropyldimethylethoxysilane, methyltrimethoxysilane, methyltriethoxysilane, dimethyldimethoxysilane, dimethyldiethoxysilane, trimethylmethoxysilane, trimethylethoxysilane, propyltrimethoxysilane, propyltriethoxysilane, hexyltrimethoxysilane, hexyltriethoxysilane, decyltrimethoxysilane and decyltriethoxysilane.

The transfer member can also have a compressive layer having a function of absorbing pressure fluctuation. The compressive layer thus established can absorb deformation, disperse local pressure fluctuation, and maintain favorable transferability even at the time of high-speed printing. Examples of the material of the compressive layer include acrylonitrile-butadiene rubber, acrylic rubber, chloroprene rubber, urethane rubber and silicone rubber. The rubber material, when molded, can be mixed with a predetermined amount of a vulcanizing agent, a vulcanization accelerator or the like and further mixed, if necessary, with a foaming agent or a filler such as a hollow particle or common salt, and the resulting porous material can be used. As a result, an air bubble portion is compressed with volume change against various pressure fluctuations. Therefore, the porous material is less deformable in a direction other than the direction of the compression. Hence, more stable transferability and durability can be obtained. The porous rubber material has a continuous pore structure where pores continue to each other, and an independent pore structure where pores are independent from each other. In the present invention, any of the structures can be used, and these structures may be used in combination.

The transfer member can further have an elastic layer between the surface layer and the compressive layer. Various materials such as resins and ceramics can be appropriately used as a material of the elastic layer. Various elastomer materials or rubber materials can be used in terms of processing characteristics, etc. Specific examples thereof include fluorosilicone rubber, phenyl silicone rubber, fluorine-containing rubber, chloroprene rubber, urethane rubber, nitrile rubber, ethylene propylene rubber, natural rubber, styrene rubber, isoprene rubber, butadiene rubber, ethylene/propylene/butadiene copolymers and nitrile butadiene rubber. Particularly, silicone rubber, fluorosilicone rubber and phenyl silicone rubber can be used in terms of dimensional stability and durability because of its small compression set. These rubbers can also be used in terms of transferability because of its small modulus of elasticity caused by temperature.

Various adhesives or double-faced tapes may be used for fixing or holding each layer (surface layer, elastic layer and compressive layer) constituting the transfer member, between these layers. Also, a reinforcement layer having a high compressive modulus of elasticity may be established in order to suppress lateral extension or keep strength in installing the transfer member in the apparatus. Alternatively, a woven fabric may be used as the reinforcement layer. The transfer member can be prepared by arbitrarily combining layers made of the materials described above.

The size of the transfer member can be arbitrarily selected according to the printing image size of interest. Examples of the shape of the transfer member specifically include, but are not particularly limited to, sheet, roller, belt and endless web shapes.

<Supporting Member>

The transfer member 101 is supported on supporting member 102. Various adhesives or double-faced tapes may be used in a method for supporting the transfer member. Alternatively, a member for installation made of a material such as a metal, a ceramic or a resin may be attached to the transfer member and thereby used to support the transfer member on the supporting member 102.

The supporting member 102 is required to have structural strength to some extent from the viewpoint of its transport accuracy and durability. A metal, a ceramic, a resin or the like can be used as a material of the supporting member. Particularly, aluminum, iron, stainless, acetal resin, epoxy resin, polyimide, polyethylene, polyethylene terephthalate, nylon, polyurethane, silica ceramic or alumina ceramic can be used for reducing inertia under operating conditions and improving the response of control, in addition to rigidity and dimension accuracy that can resist pressurization at the time of transfer. Alternatively, these materials may be used in combination.

<Reaction Solution Application Apparatus>

The inkjet recording apparatus of the present embodiment has reaction solution application apparatus 103 which applies a reaction solution to the transfer member 101. The reaction solution application apparatus 103 of FIG. 1 is illustrated as a gravure offset roller having reaction solution reservoir 103*a* which accommodates the reaction solution, and reaction solution applying members 103*b* and 103*c* which apply the reaction solution in the reaction solution reservoir 103*a* onto the transfer member 101.

The reaction solution application apparatus may be any apparatus that can apply the reaction solution onto the ejection receiving medium, and various apparatuses conventionally known can be appropriately used. Specific examples thereof include gravure offset rollers, inkjet heads, die coating apparatuses (die coaters) and blade coating apparatuses (blade coaters). The application of the reaction solution by the reaction solution application apparatus may be performed before or after application of ink as long as the reaction solution can be mixed (reacted) with the ink on the ejection receiving medium. The reaction solution can be applied before application of ink. The application of the reaction solution before application of ink can also suppress bleeding (mingling of adjacently applied ink droplets) and beading (attraction of an ink droplet landed first to an ink droplet landed later) during image recording based on an inkjet system.

<Reaction Solution>

The reaction solution allows an anionic group-containing component (a resin, a self-dispersing pigment, etc.) in ink to agglomerate by contact with the ink, and contains a reactant. Examples of the reactant can include cationic components such as polyvalent metal ions and cationic resins, and organic acids.

Examples of the polyvalent metal ion include: divalent metal ions such as $Ca^{2+}$, $Cu^{2+}$, $Ni^{2+}$, $Mg^{2+}$, $Sr^{2+}$, $Ba^{2+}$ and $Zn^{2+}$; and trivalent metal ions such as $Fe^{3+}$, $Cr^{3+}$, $Y^{3+}$ and $Al^{3+}$. A polyvalent metal salt (which may be a hydrate) constituted by the bonding of the polyvalent metal ion to an anion can be used for allowing the reaction solution to contain the polyvalent metal ion. Examples of the anion can include: inorganic anions such as $Cl^-$, $Br^-$, $I^-$, $ClO^-$, $ClO_2^-$, $ClO_3^-$, $ClO_4^-$, $NO_2^-$, $NO_3^-$, $SO_4^{2}$, $CO_3^{2-}$, $HCO_3^-$, $PO_4^{3-}$, $HPO_4^{2-}$ and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$ and $CH_3SO_3^-$. In the case of using the polyvalent metal ion as the reactant, the content (% by mass) thereof based on a polyvalent metal salt in the reaction solution can be 1.00% by mass or more to 10.00% by mass or less with respect to the total mass of the reaction solution.

The reaction solution containing the organic acid has buffering ability in an acidic region (less than pH 7.0, preferably pH 2.0 to 5.0) and thereby renders the anionic group of the ink component acidic for agglomeration. Examples of the organic acid can include: monocarboxylic acids such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophenecarboxylic acid, levulinic acid and coumarinic acid, and salts thereof, dicarboxylic acids such as oxalic acid, malonic acid, succinic acid, glutaric acid, adipic acid, maleic acid, fumaric acid, itaconic acid, sebacic acid, phthalic acid, malic acid and tartaric acid, and salts and hydrogen salts thereof; tricarboxylic acids such as citric acid and trimellitic acid, and salts and hydrogen salts thereof, and tetracarboxylic acids such as pyromellitic acid, and salts and hydrogen salts thereof.

Examples of the cationic resin can include resins having primary to tertiary amine structures and resins having a quaternary ammonium salt structure. Specific examples thereof can include resins having a vinylamine, allylamine, vinylimidazole, vinylpyridine, dimethylaminoethyl methacrylate, ethylenimine or guanidine structure. The cationic resin may be used in combination with an acidic compound or may be subjected to quaternarization treatment in order to enhance solubility in the reaction solution. In the case of using the cationic resin as the reactant, the content (% by mass) of the cationic resin in the reaction solution can be 1.00% by mass or more to 10.00% by mass or less with respect to the total mass of the reaction solution.

Water, water-soluble organic solvent, other additives, etc. listed as components that can be used in ink mentioned later can be similarly used as components other than the reactant in the reaction solution.

<Ink Application Apparatus>

The inkjet recording apparatus of the present embodiment has ink application apparatus 104 which applies ink to the transfer member 101. On the transfer member, the reaction solution and ink are mixed so that an ink image is formed by the reaction solution and the ink. Then, a liquid component is absorbed from the ink image by the liquid absorption apparatus 105.

In the present embodiment, inkjet head is used as the ink application apparatus which applies ink. Examples of the inkjet head include a form that ejects ink by forming air bubbles resulting from film boiling in ink using a thermoelectric converter, a form that ejects ink through an electromechanical converter, and a form that ejects ink by utilizing static electricity. Particularly, a form utilizing a thermoelectric converter is suitably used from the viewpoint of high-speed and high-density printing in the present embodiment. In drawing, ink is applied in a necessary amount to each position in response to image signals. The specific configuration of an inkjet head as to ink circulation and the like is mentioned below.

In the present embodiment, the inkjet head is a full-line head that runs in the Y direction, and ejection ports are arranged in a range that covers the width of an image recording region of a recording medium having the maximum possible size. The inkjet head has, on its underside (transfer member 101 side), an ink ejecting face where the ejection ports are open. The ink ejecting face faces the surface of the transfer member 101 via a very small space (approximately several mm).

The amount of the ink applied can be expressed as an image density (duty) and ink thickness. In the present embodiment, the amount of the ink applied ($g/m^2$) is defined as an average value determined by multiplying the mass of each ink dot by the number of ink dots applied and dividing the resulting value by a printing area. The maximum amount of the ink applied in an image region refers to the amount of the ink applied to an area of at least 5 $mm^2$ or more within a region used as information on an ejection receiving medium, from the viewpoint of removing a liquid component in the ink.

The ink application apparatus 104 may have a plurality of inkjet heads in order to apply each color ink onto the ejection receiving medium. In the case of forming respective color images using, for example, yellow ink, magenta ink, cyan ink and black ink, the ink application apparatus can have four inkjet heads for ejecting the above-mentioned four types of ink onto an ejection receiving medium, respectively. These inkjet heads are arranged in the X direction.

The ink application apparatus may also include an inkjet head which ejects substantially clear, colorless ink free from a color material or containing a color material at a very low proportion. This clear ink can be used for forming an ink image together with the reaction solution and color ink. For example, this clear ink can be used for improving the gross of an image. A resin component to be contained therein can be appropriately adjusted so as to create the gross of an image after transfer. In addition, the ejection position of the clear ink can be controlled. Since it is more desirable that this clear ink should be positioned closer to the surface layer than color ink in a final recorded article, the transfer-type recording apparatus is configured such that the clear ink is applied onto the transfer member 101 before the color ink. Therefore, the inkjet head for the clear ink can be disposed upstream of the inkjet head for the color ink in the moving direction of the transfer member 101 which faces the ink application apparatus 104.

Aside from the gross purpose, the clear ink can be used for improving the ink image transferability from the transfer member 101 to a recording medium. For example, clear ink richer in a component that exerts adhesiveness than color ink can be applied to color ink and thereby used as a transferability improving liquid that is applied onto the transfer member 101. For example, the inkjet head for the clear ink for improvement in transferability is disposed downstream of the inkjet head for the color ink in the moving direction of the transfer member 101 which faces the ink application apparatus 104. The clear ink is located on the uppermost surface of an ink image by applying the color ink onto the transfer member 101 and then applying the clear ink onto the transfer member thus provided with the color ink. In the transfer of an ink image to a recording medium by the transfer part, the clear ink on the surface of the ink image adheres to the recording medium 108 with adhesive force to some extent. This facilitates the movement of the ink image after liquid removal to the recording medium 108.

<Ink>

Each component of the ink that is applied to the present embodiment will be described.

(Color Material)

A pigment or a dye can be used as a color material contained in the ink applied to the present embodiment. The content of the color material in the ink is preferably 0.5% by mass or more to 15.0% by mass or less, more preferably 1.0% by mass or more to 10.0% by mass or less, with respect to the total mass of the ink.

The type of the pigment which can be used as the color material is not particularly limited. Specific examples of the pigment can include: inorganic pigments such as carbon black and titanium oxide; and organic pigments such as azo, phthalocyanine, quinacridon, isoindolinone, imidazolone, diketopyrrolopyrrole and dioxazine pigments. One or more of these pigments can be used if needed. A method for dispersing a pigment is not particularly limited. For example, a resin-dispersible pigment dispersed by a resin dispersant and a self-dispersible pigment wherein hydrophilic groups such as anionic groups are bonded to the particle surface of the pigment directly or through other atomic groups can be used. Of course, pigments different in the dispersion process can also be used in combination.

Resin dispersants known in the art used for aqueous inkjet ink can be used as a resin dispersant for dispersing a pigment. Especially a water-soluble acrylic resin dispersant having a hydrophilic unit and a hydrophobic unit in a molecular chain can be used in an aspect of the present embodiment. Examples of the form of the resin include a block copolymer, a random copolymer, a graft copolymer and a combination thereof.

A resin dispersant in ink may be dissolved in a liquid medium, and may be dispersed in a liquid medium as a resin particle. In the present invention, the term "water-soluble" as to a resin means that a particle having a particle size measurable by a dynamic light scattering method is not formed when the resin is neutralized with an alkali equivalent to its acid number.

The hydrophilic unit (unit having a hydrophilic group such as an anionic group) can be formed, for example, by polymerizing a monomer having a hydrophilic group. Specific examples of the monomer having a hydrophilic group can include anionic monomers such as acidic monomers having an anionic group such as (meth)acrylic acid or maleic acid, and an anhydride and a salt of these acidic monomers. Examples of a cation which constitutes a salt of the acid monomer can include ions such as lithium, sodium, potassium, ammonium and an organic ammonium.

A hydrophobic unit (unit not having a hydrophilic group such as an anionic group) can be formed, for example, by polymerizing a monomer having a hydrophobic group. Specific examples of the monomer having a hydrophobic group can include monomers such as styrene, alpha-methylstyrene and benzyl (meth)acrylate having an aromatic ring; and monomers such as ethyl (meth)acrylate, methyl (meth)acrylate and butyl (meth)acrylate having an aliphatic group (namely, (meth)acrylic ester monomers).

The acid number of the resin dispersant is preferably 50 mg KOH/g or more to 550 mg KOH/g or less, and more preferably 100 mg KOH/g or more to 250 mg KOH/g or less. The weight average molecular weight of the resin dispersant can be 1,000 or more to 50,000 or less. The content (% by mass) of the pigment can be 0.3 or more times to 10.0 or less times in terms of mass ratio to the content of the resin dispersant (pigment/resin dispersant).

A pigment containing an anionic group such as a carboxylic acid group, a sulfonic acid group or a phosphonic acid group bonded directly or via an additional atomic group (—R—) to the particle surface can be used as the self-dispersing pigment. The anionic group can be any of acid and salt types. The salt-type anionic group can be in any of a partially dissociated state and a wholly dissociated state. Examples of the cation serving as a counterion for the salt-type anionic group can include: alkali metal cations; ammonium cations; and organic ammonium cations. Specific examples of the additional atomic group (—R—) can include linear or branched alkylene groups having 1 to 12 carbon atoms, arylene groups such as a phenylene group and a naphthylene group, amide groups, sulfonyl groups, amino groups, carbonyl groups, ester groups, and ether groups. A group containing these groups in combination may be used.

The type of a dye which can be used as a color material is not particularly limited, and a dye having an anionic group can be used. Examples of the dye include azo compounds, triphenylmethane, (aza-)phthalocyanine, xanthene and anthrapyridone. One or two or more of these dyes can be used if needed.

A so-called self-dispersible pigment which is dispersible without a dispersant by modifying the surface of the pigment itself is suitably used in the present embodiment.

(Resin Particle)

Ink applied to the present embodiment can contain a resin particle. The resin particle does not need to contain a color material. The resin particle may suitably have an effect on improvement in image quality or fixability.

The material of the resin particle which can be used for the present embodiment is not particularly limited, and resins known in the art can be properly used. Specific examples of the resin particle include resin particles including various materials such as olefin, polystyrene, urethane and acrylic. The weight average molecular weight (Mw) of the resin particle is suitably in the range of 1,000 or more to 2,000,000 or less. The volume average particle size measured by the dynamic light scattering method of the resin particle is preferably 10 nm or more to 1,000 nm or less, and more preferably 100 nm or more to 500 nm or less. The content (% by mass) of the resin particle in the ink is preferably 1.0% by mass or more to 50.0% by mass or less, and more preferably 2.0% by mass or more to 40.0% by mass or less with respect to the total mass of the ink.

(Solvent)

The ink according to the present embodiment contains 5 to 30% by mass of a water-soluble organic solvent having a boiling point of 110° C. or more. When the content of the water-soluble organic solvent is less than 5% by mass, the ejection of the ink from the inkjet head becomes unstable, and image quality decreases. Meanwhile, when the content of the water-soluble organic solvent is more than 30% by mass, the amount of the water-soluble organic solvent remaining in the formed image increases, resulting in decreases in image quality and image stability. The content of the water-soluble organic solvent is preferably 10 to 25% by mass, and more preferably 15 to 25% by mass. Examples of the water-soluble organic solvent having a boiling point of 110° C. or more include glycerin and ethylene glycol monomethyl ether. One or two or more of these water-soluble organic solvents may also be contained. When the ink contains two or more water-soluble organic solvents having a boiling point of 110° C. or more, the content of the water-soluble organic solvents means the total content of the water-soluble organic solvents. The upper limit of the boiling point of the water-soluble organic solvent having a boiling point of 110° C. or more is not particularly limited, and a water-soluble organic solvent having, for example, a boiling point of 110° C. or more to 250° C. or less can be used.

The ink according to the present embodiment can contain water or a water-soluble organic solvent having a boiling point of less than 110° C. besides the water-soluble organic solvent having a boiling point of 110° C. or more. Deionized water or ion-exchange water can be used as the water. The content (% by mass) of the water in the ink can be 50.0% by mass or more to 95.0% by mass or less with respect to the total mass of the ink.

(Other Additives)

The ink which can be used for the present embodiment may contain various additives such as an antifoaming agent, a surfactant, a pH adjuster, a viscosity adjuster, a rust inhibitor, an antiseptic, a mold inhibitor, an antioxidant, a reduction inhibitor and a water-soluble resin, if necessary, in addition to the components described above.

<Liquid Absorption Apparatus>

In the present embodiment, the liquid absorption apparatus 105 has liquid absorbing member 105*a* having a porous body; and pressing member 105*b* for liquid absorption which presses the liquid absorbing member 105*a* against an ink image on the transfer member 101. The shapes of the liquid absorbing member 105*a* and the pressing member 105*b* are not particularly limited. For example, as illustrated in FIG. 1, this apparatus can have pressing member 105*b* having a columnar shape and liquid absorbing member 105*a* having a belt shape and is configured such that the columnar-shaped pressing member 105*b* presses the belt-shaped liquid absorbing member 105*a* against the transfer member 101. Alternatively, the apparatus may have pressing member 105*b* having a columnar shape and liquid absorbing member 105*a* having a cylindrical shape formed on the peripheral surface of the columnar-shaped pressing member 105*b* and is configured such that the columnar-shaped pressing member 105*b* presses the cylindrical-shaped liquid absorbing member 105*a* against the transfer member. In the present embodiment, the liquid absorbing member 105*a* can have a belt shape in consideration of space within the inkjet recording apparatus, etc. The liquid absorption apparatus 105 having such a belt-shaped liquid absorbing member 105*a* may have a tension member which tensions the liquid absorbing member 105*a*. In FIG. 1, reference numeral 105*c* denotes a tension roller as the tension member. In FIG. 1, the pressing member 105*b* is illustrated as a roller member that rotates, as in the tension roller, but is not limited thereto.

In the liquid absorption apparatus 105, the liquid absorbing member 105*a* having a porous body is pressed in contact with the ink image by the pressing member 105*b* so that a liquid component contained in the ink image is absorbed to the liquid absorbing member 105*a* to decrease the amount of the liquid component. In addition to this system of bringing the liquid absorbing member in contact, various other approaches conventionally used, for example, a method based on heating, a method of blowing low humid air and a method of reducing pressure may be combined as a method for decreasing the amount of the liquid component in the ink image. Alternatively, the amount of the liquid component may be further decreased by applying these methods to the ink image having a decreased amount of the liquid component after the liquid removal.

<Liquid Absorbing Member>

In the present embodiment, at least a portion of a liquid component is removed from the ink image before liquid removal by absorption in contact with the liquid absorbing member having a porous body to decrease the content of the liquid component in the ink image. When a contact face of the liquid absorbing member for the ink image is defined as a first face, the porous body is disposed on the first face. The liquid absorbing member having such a porous body can have a shape capable of absorbing a liquid by circulation which involves moving in tandem with the movement of an ejection receiving medium, coming into contact with the ink image, and then coming into contact again with another ink image before liquid removal at a predetermined cycle. Examples of the shape include endless belt and drum shapes.

(Porous Body)

The porous body of the liquid absorbing member according to the present embodiment can have a smaller average pore size on the first face side than that on the second face side which is opposed to the first face. The pore size can be small in order to suppress the adhesion of the color material in the ink to the porous body. The average pore size of the porous body on the first face side that comes into contact with an ink image can be 10 μm or less. In the present embodiment, the average pore size refers to an average diameter on the surface of the first face or the second face and can be measured by a unit, for example, a mercury intrusion method, a nitrogen adsorption method or a SEM image observation.

The porous body can have a small thickness in order to attain uniformly high air permeability. The air permeability can be indicated by Gurley value defined by JIS P8117. The Gurley value can be 10 seconds or less. However, a thin porous body may not sufficiently secure a necessary capacity for absorbing the liquid component. Therefore, the porous body may have a multilayer configuration. In the liquid absorbing member according to the present embodiment, the layer that comes into contact with an ink image can have the porous body, and a layer that does not come into contact with the ink image may not have the porous body.

Next, an embodiment in which the porous body has a multilayer configuration will be described. In this description, the layer that comes into contact with an ink image is defined as a first layer, and a layer located on a face opposed to the ink image contact face of the first layer is defined as a second layer. The multilayer configuration is also expressed in the order of lamination from the first layer. In the present specification, the first layer is also referred to as an "absorption layer", and the second or more layers are also referred to as "supporting layers".

[First Layer]

In the present embodiment, the material of the first layer which is a porous body is not particularly limited, and any of a hydrophilic material having a contact angle of less than 90° for water and a water-repellent material having a contact angle of 90° or more for water can be used.

The hydrophilic material can be selected from, for example, single materials such as cellulose and polyacrylamide and composite materials thereof. Alternatively, a water-repellent material described below may be used after hydrophilization treatment of its surface. Examples of the hydrophilization treatment include methods such as sputter etching, exposure to radiation or $H_2O$ ions and excimer (ultraviolet) laser light irradiation. The hydrophilic material can have a contact angle of 60° or less for water. The hydrophilic material has an effect of soaking up a liquid, particularly, water by capillary force.

On the other hand, the material of the first layer is preferably a water-repellent material having low surface free energy, more preferably a fluorine compound, and still more preferably fluorinated resin, in order to suppress the adhesion of the color material and enhance cleaning properties. That is, the liquid absorbing member can have a porous body which comes into contact with an ink image and which contains a fluorine compound. Specific examples of the fluorinated resin include polytetrafluoroethylene (PTFE), polychlorotrifluoroethylene (PCTFE), polyvinylidene fluoride (PVDF), polyvinyl fluoride (PVF), perfluoroalkoxy (PFA), fluorinated ethylene-propylene (FEP), ethylene tetrafluoroethylene (ETFE) and ethylene chlorotrifluoroethylene (ECTFE). One or two or more of these resins can be used, if necessary. The first layer may be configured such that a plurality of layers are laminated. The water-repellent material rarely has an effect of soaking a liquid up by capillary force and may require time for soaking a liquid up upon first contact with an ink image. Therefore, the first layer can be infiltrated with a liquid having a contact angle of less than 90° for the first layer. This liquid can be infiltrated into the first layer by coating therewith the first face of the liquid absorbing member. This liquid can be prepared by mixing water with a surfactant or a liquid having a low contact angle for the first layer.

In the present embodiment, the thickness of the first layer is preferably 50 μm or less, and more preferably 30 μm or less. In the present embodiment, the film thickness is obtained by measuring film thicknesses at arbitrary 10 points using a non-rotating spindle micrometer OMV_25 (manufactured by Mitutoyo Corp.) and calculating an average value thereof.

The first layer can be produced by a thin porous film production method known in the art. The first layer can be obtained, for example, by obtaining a sheet-like article by a method such as extrusion molding using a resin material and then drawing the sheet-like article into a predetermined thickness. Alternatively, a porous film can be obtained by adding a plasticizer such as paraffin to a material for extrusion molding and removing the plasticizer by heating or the like during drawing. The pore size can be adjusted by appropriately adjusting the amount of the plasticizer added, the draw ratio, etc.

[Second Layer]

In the present embodiment, the second layer can be a layer having air permeability. Such a layer may be a nonwoven fabric or a woven fabric of resin fiber. The material of the second layer is not particularly limited and can be a material having a contact angle for a liquid component equivalent to or lower than that of the first layer so as to prevent the backward current of the liquid component absorbed to the first layer. Specifically, the material of the second layer can be selected from single materials such as polyolefin (polyethylene (PE), polypropylene (PP), etc.), polyurethane, polyamide such as nylon, polyester (polyethylene terephthalate (PET), etc.) and polysulfone (PSF), and composite materials thereof. The second layer can be a layer having a larger pore size than that of the first layer.

[Third Layer]

The third layer or more layers can be nonwoven fabrics from the viewpoint of rigidity. A material similar to that of the second layer is used.

[Other Members]

The liquid absorbing member may have a reinforcement member which reinforces the lateral face of the liquid absorbing member, in addition to the porous body having a layered structure as described above. Also, the liquid absorbing member may have a joining member for preparing a belt-like member by connecting the ends in the longitudinal directions of a long sheet-shaped porous body. A nonporous tape material can be used as such a member and can be disposed at a position or a cycle in no contact with an ink image.

[Method for Producing Porous Body]

When the porous body is formed by laminating the first layer and the second layer, the production method is not particularly limited. The first layer and the second layer may be merely deposited on each other or may be bonded to each other using a method such as adhesive lamination or thermal lamination. Thermal lamination in which the first layer and the second layer are heated while being inserted between heated rollers and pressed can be used from the viewpoint of air permeability. Alternatively, for example, a portion of the first layer or the second layer may be melted by heating, resulting in the bond of both. A fusion material such as a hot-melt powder may be allowed to intervene between the first layer and the second layer, which are in turn adhesively laminated with each other by heating. In the case of laminating the third or more layers, these layers may be laminated at once or may be sequentially laminated. The order of lamination is appropriately selected.

(Pretreatment)

In the present embodiment, the liquid absorbing member 105*a* having a porous body can be pretreated by a pretreatment unit (not shown in FIGS. 1 and 2) which applies a treatment solution to the liquid absorbing member before contact with an ink image. The treatment solution used in the present embodiment can contain water and a water-soluble organic solvent. The water can be water deionized by ion exchange or the like. The type of the water-soluble organic solvent is not particularly limited, and any organic solvent known in the art, such as ethanol or isopropyl alcohol can be used. In the pretreatment of the liquid absorbing member used in the present embodiment, the application method is not particularly limited, and dipping or dropwise addition of liquid droplets can be used.

(Pressurization Condition)

The pressure of the liquid absorbing member upon contact with an ink image on the transfer member is preferably 2.9 $N/cm^2$ (0.3 $kgf/cm^2$) or more because the solid-liquid separation of a liquid component in the ink image can be achieved in a shorter time and the liquid component can be removed from the ink image. In the present specification, the pressure of the liquid absorbing member refers to the nip pressure between an ejection receiving medium and the liquid absorbing member and is a value calculated by performing surface pressure measurement using a surface pressure distribution sensor (trade name: I-SCAN, manufactured by Nitta Corp.) and dividing a load in a pressurization region by an area.

(Duration of Action)

The duration of action for the contact of the liquid absorbing member 105*a* with an ink image can be 50 ms or less in order to further suppress the adhesion of the color material in the ink image to the liquid absorbing member. In the present specification, the duration of action is calculated by dividing a pressure sensing width in the moving direction of the ejection receiving medium by the movement speed of the ejection receiving medium, in the surface pressure measurement mentioned above. Hereinafter, this duration of action is referred to as a liquid absorption nip time.

(Removal of Water-Soluble Organic Solvent Having a Boiling Point of 110° C. or More)

In the present invention, 50% by mass or more of the water-soluble organic solvent contained in the ink image and having a boiling point of 110° C. or more is removed from the ink image when at least a portion of a liquid component is removed from the ink image. Therefore, since the content of the water-soluble organic solvent having a boiling point of 110° C. or more in an ink image decreases, decreases in the image quality and the image stability of the obtained image can be suppressed. The rate of the water-soluble organic solvent having a boiling point of 110° C. or more and removed from the ink image (hereinafter also expressed as a removal rate) is preferably 60% by mass or more, and more preferably 70% by mass or more. The upper limit of the range of the removal rate is not particularly limited, and the substantial upper limit of the removal rate is 100% by mass or less. The water-soluble organic solvent contained in the ink image and having a boiling point of 110° C. or more may contain a water-soluble organic solvent derived from not only the ink but also the reaction solution. The removal rate can be 50% by mass or more by properly selecting the material of the liquid absorbing member 105*a*, the type of the water-soluble organic solvent contained in the ink image and having a boiling point of 110° C. or more, and the like. The removal rate is obtained by measuring the contents of the water-soluble organic solvent contained in the ink image and having a boiling point of 110° C. or more, respectively, from the absorbance of the infrared absorption spectra of the ink image before and after the removal of the liquid component and calculating the rate of change therein. The removal rate is a rate based on the total mass of the water-soluble organic solvent contained in the ink image before the removal of the liquid component and having a boiling point of 110° C. or more.

<Heating Apparatus>

The inkjet recording apparatus according to the present embodiment can include a heating apparatus which heats the ink image to T° C. (heating temperature). Here, the boiling point of the water-soluble organic solvent contained in the ink image and having a boiling point 110° C. or more can be higher than T° C. (heating temperature). The heating of the ink image to T° C. can remove the liquid component contained in an ink image, and improve the cohesive force of the ink image by softening of resin or a resin particle. On the other hand, when the removal of the liquid component in the ink is promoted by heating, the concentration of the ink may change rapidly, resulting in a decrease in image quality. Therefore, the ink image can be heated at a temperature less than the boiling point of the water-soluble organic solvent contained in the ink image and having a boiling point of 110° C. or more. Specifically, the heating temperature (T° C.) of an ink image is preferably 80° C. or more to 200° C. or less, more preferably 100° C. or more to 150° C. or less, and still more preferably 110° C. or more to 150° C. The heating apparatus is not particularly limited, and an apparatus known in the art such as a heating apparatus by infrared rays can be used properly. The ink image may be heated by the heating apparatus before the removal of the liquid component by the liquid absorption apparatus or after the removal of the liquid component. The heating temperature of the ink image can be measured using a noncontact infrared thermometer.

<Pressing Member for Transfer>

In the present embodiment, the ink image on the transfer member 101 from which the liquid component is removed is brought into contact with the recording medium 108 transported by a recording medium transport unit 107 by pressing member 106 for transfer, and the ink image is transferred onto the recording medium 108 thereby. After removal of a liquid component contained in the ink image on the transfer member 101, the image is transferred to the recording medium 108. A recording image in which curl, cockling, etc. are suppressed can be obtained.

The pressing member 106 is required to have structural strength to some extent from the viewpoint of recording medium 108 transport accuracy and durability. A metal, a ceramic, a resin or the like can be used as a material of the pressing member 106. Particularly, aluminum, iron, stainless, acetal resin, epoxy resin, polyimide, polyethylene, polyethylene terephthalate, nylon, polyurethane, silica ceramic or alumina ceramic can be used for reducing inertia under operating conditions and improving the response of control, in addition to rigidity and dimension accuracy that can resist pressurization at the time of transfer. Alternatively, these materials may be used in combination.

The time of pressing the pressing member 106 against the transfer member to transfer the ink image on the transfer member 101 from which the liquid is removed to the recording medium 108 is not particularly limited and can be 5 ms or more to 100 ms or less in order to favorably perform the transfer without impairing the durability of the transfer member. The pressing time according to the present embodiment refers to a time for which the recording medium 108 and the transfer member 101 are in contact with each other and is a value calculated by performing surface pressure measurement using a surface pressure distribution sensor (product name: I-SCAN, manufactured by NITTA Corp.) and dividing the length in the transport direction of a pressurization region by a transport speed.

The pressure under which the pressing member 106 is pressed against the transfer member 101 to transfer the ink image on the transfer member 101 from which the liquid is removed to the recording medium 108 is not particularly limited, and the pressure is adjusted in order to favorably perform the transfer without impairing the durability of the transfer member. Therefore, the pressure can be 9.8 $N/cm^2$ (1 $kg/cm^2$) or more to 294.2 $N/cm^2$ (30 $kg/cm^2$) or less. The pressure according to the present embodiment refers to the nip pressure between the recording medium 108 and the transfer member 101 and is a value calculated by performing surface pressure measurement using a surface pressure distribution sensor and dividing a load in a pressurization region by an area.

The temperature at the time of pressing the pressing member 106 against the transfer member 101 in order to transfer the ink image on the transfer member 101 from which a liquid is removed to the recording medium 108 is not particularly limited and can be equal to or higher than the glass transition point or the softening point of the resin component contained in the ink. A form including heating units which heat the ink image on the transfer member 101 from which the liquid is removed, the transfer member 101 and the recording medium 108 can be used for heating.

Examples of the shape of the pressing member 106 include, but are not particularly limited to, a roller shape.

<Recording Medium and Recording Medium Transport Apparatus>

In the present embodiment, the recording medium 108 is not particularly limited, and any recording medium known in the art can be used. Examples of the recording medium include long materials wound into a roll shape and sheets cut into a predetermined dimension. Examples of the material include paper, plastic films, wooden boards, cardboards and metal films.

In FIG. 1, the recording medium transport apparatus 107 for transporting the recording medium 108 is constituted by recording medium feeding roller 107*a* and recording medium winding roller 107*b*. However, the recording medium transport apparatus 107 is not particularly limited by this configuration as long as the recording medium transport apparatus 107 can transport the recording medium.

<Control System>

Figure 3:
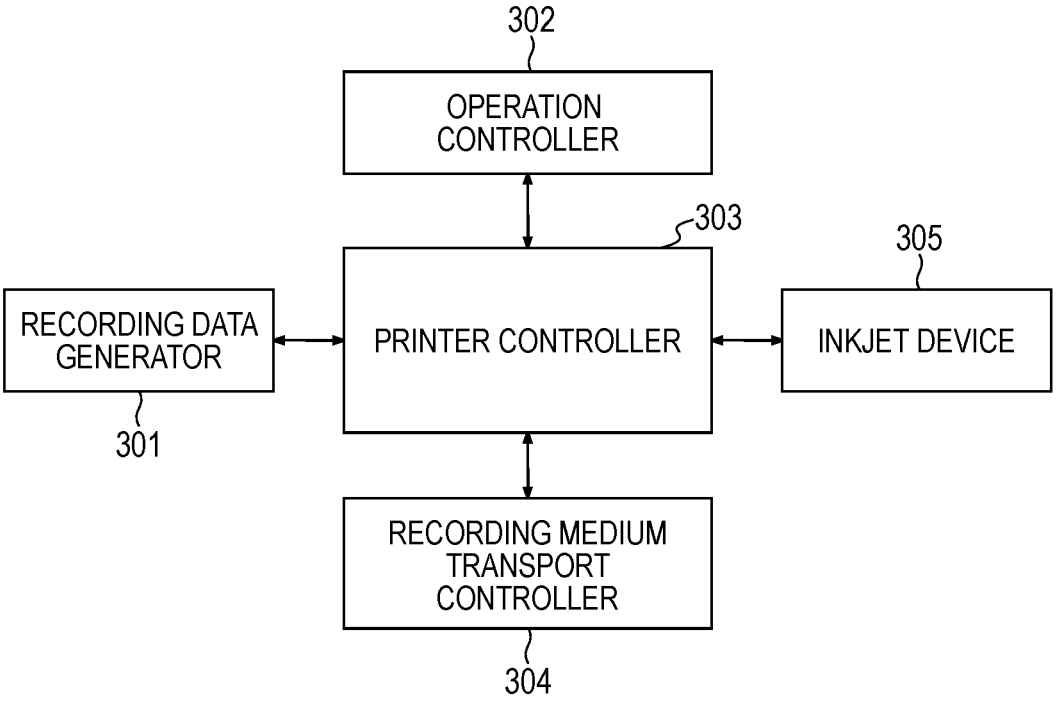
FIG. 3 is a block diagram illustrating a control system of the whole apparatus for the inkjet recording apparatus illustrated in FIG. 1 or 2.

The transfer-type inkjet recording apparatus according to the present embodiment has a control system which controls each apparatus. FIG. 3 is a block diagram illustrating a control system of the whole apparatus for the transfer-type inkjet recording apparatus illustrated in FIG. 1.

In FIG. 3, reference numeral 301 denotes a recording data generator such as an external print server. Reference numeral 302 denotes an operation controller such as an operating panel. Reference numeral 303 denotes a printer controller for executing a recording process. Reference numeral 304 denotes a recording medium transport controller for transporting the recording medium. Reference numeral 305 denotes an inkjet device for printing.

Figure 4:
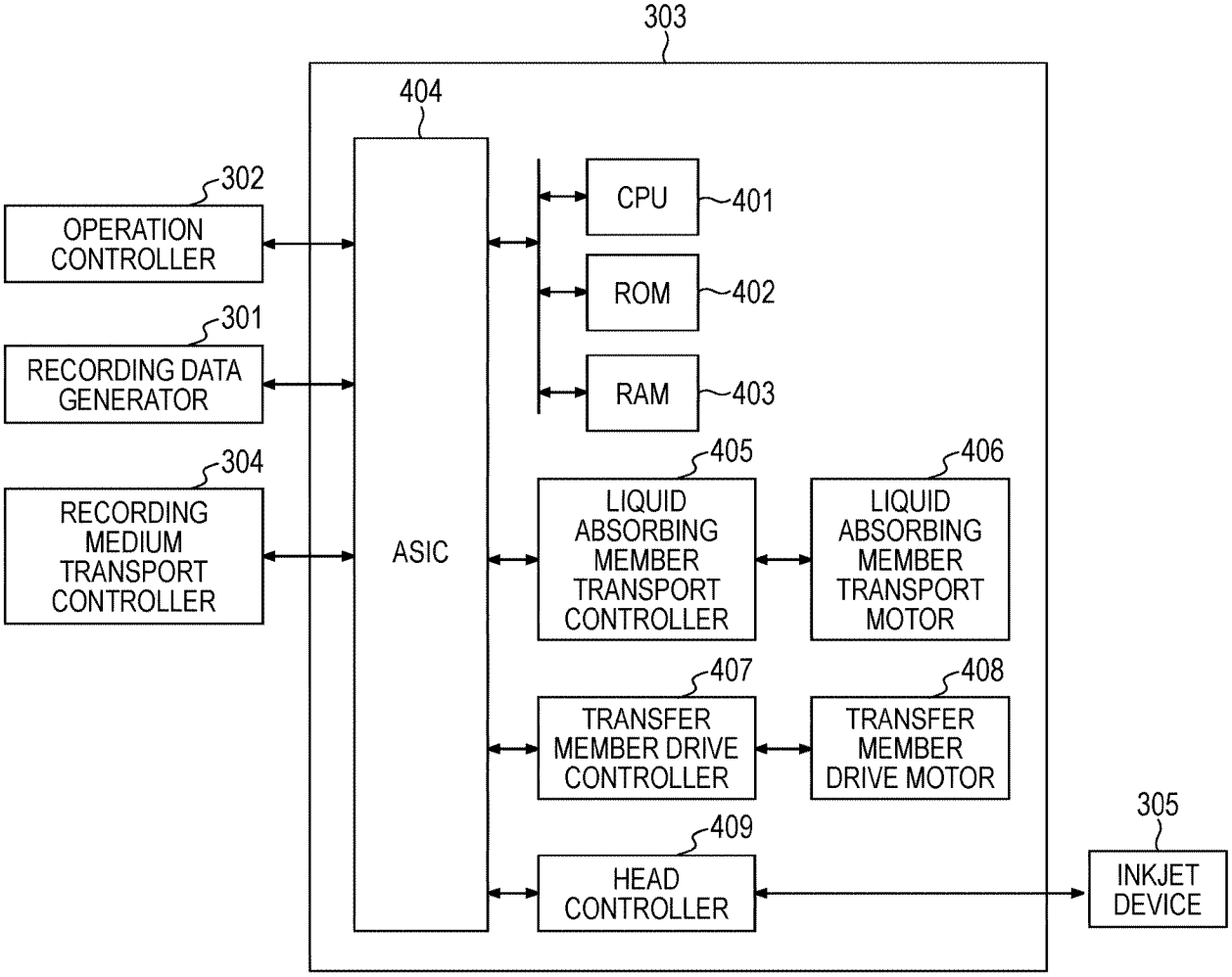
FIG. 4 is a block diagram of a printer controller in the transfer-type inkjet recording apparatus illustrated in FIG. 1.

FIG. 4 is a block diagram of a printer controller in the transfer-type inkjet recording apparatus of FIG. 1.

Reference numeral 401 denotes CPU which controls the whole printer. Reference numeral 402 denotes ROM which stores the control program of the CPU 401. Reference numeral 403 denotes RAM for executing the program. Reference numeral 404 denotes an application specific integrated circuit (ASIC) having an embedded network controller, serial IF controller, controller for head data generation, motor controller and the like. Reference numeral 405 denotes a liquid absorbing member transport controller for driving liquid absorbing member transport motor 406. The liquid absorbing member transport controller is command-controlled from the ASIC 404 via serial IF. Reference numeral 407 denotes a transfer member drive controller for driving transfer member drive motor 408. The transfer member drive controller is also command-controlled from the ASIC 404 via serial IF. Reference numeral 409 denotes a head controller which performs the final ejection data generation, driving voltage generation, etc. of the inkjet device 305.

[Direct Writing-Type Inkjet Recording Apparatus]

Another example of the present embodiment includes a direct writing-type inkjet recording apparatus. In the direct writing-type inkjet recording apparatus, the ejection receiving medium is a recording medium on which an image is to be formed.

Figure 2:
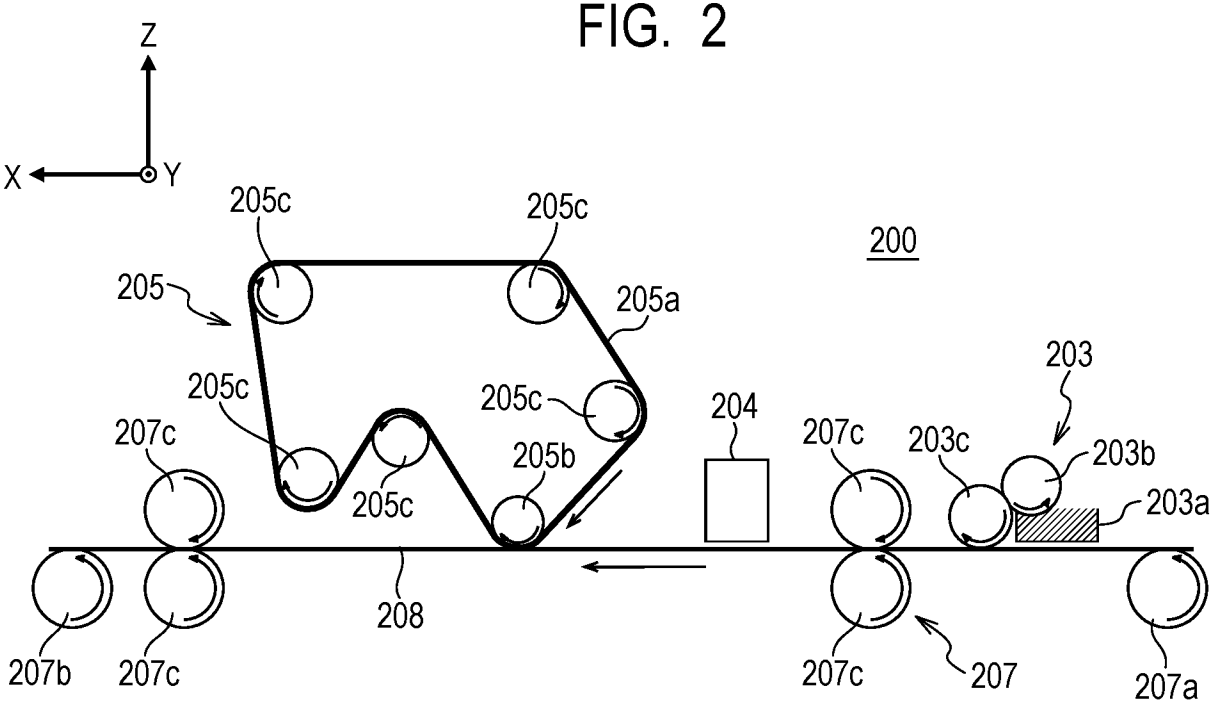
FIG. 2 is a schematic view illustrating one example of the configuration of a direct writing-type inkjet recording apparatus according to one embodiment of the present invention.

FIG. 2 is a schematic view illustrating one example of the configuration outline of direct writing-type inkjet recording apparatus 200 according to the present embodiment. The direct writing-type inkjet recording apparatus compared with the transfer-type inkjet recording apparatus mentioned above is similar in unit to the transfer-type inkjet recording apparatus except that the direct writing-type inkjet recording apparatus lacks the transfer member 101, the supporting member 102 and the transfer member cleaning member 109 and forms an image on recording medium 208.

Thus, reaction solution application apparatus 203 which applies a reaction solution to the recording medium 208, ink application apparatus 204 which applies ink to the recording medium 208, and liquid absorption apparatus 205 which absorbs a liquid component contained in an ink image on the recording medium 208 by the contact of liquid absorbing member 205*a* with the ink image are configurationally similar to those in the transfer-type inkjet recording apparatus, so that the description is omitted.

In the direct writing-type inkjet recording apparatus of the present embodiment, the liquid absorption apparatus 205 has liquid absorbing member 205*a* and pressing member 205*b* for liquid absorption which presses the liquid absorbing member 205*a* against an ink image on the recording medium 208. The shapes of the liquid absorbing member 205*a* and the pressing member 205*b* are not particularly limited and can be similar to the shapes of the liquid absorbing member and the pressing member that can be used in the transfer-type inkjet recording apparatus. The liquid absorption apparatus 205 may also have a tension member which tensions the liquid absorbing member. In FIG. 2, reference numerals 205*c* denote tension rollers as the tension member. The number of tension rollers is not limited to 5 in FIG. 2, and a necessary number of tension rollers can be disposed according to apparatus design. A recording medium supporting member (not shown) which supports the recording medium from below may be disposed in an ink applying part which applies ink to the recording medium 208 by the ink application apparatus 204, and a liquid component removing part which removes a liquid component by the contact of the liquid absorbing member 205*a* with an ink image on the recording medium.

<Recording Medium Transport Apparatus>

In the direct writing-type inkjet recording apparatus of the present embodiment, recording medium transport apparatus 207 is not particularly limited, and a transport unit in a direct writing-type inkjet recording apparatus known in the art can be used. Examples thereof include a recording medium transport apparatus having recording medium feeding roller 207*a*, recording medium winding roller 207*b* and recording medium transport roller 207*c*, as illustrated in FIG. 2.

<Control System>

The direct writing-type inkjet recording apparatus according to the present embodiment has a control system which controls each apparatus. A block diagram illustrating a control system of the whole apparatus for the direct writing-type inkjet recording apparatus illustrated in FIG. 2 is as illustrated in FIG. 3, as in the transfer-type inkjet recording apparatus illustrated in FIG. 1.

Figure 5:
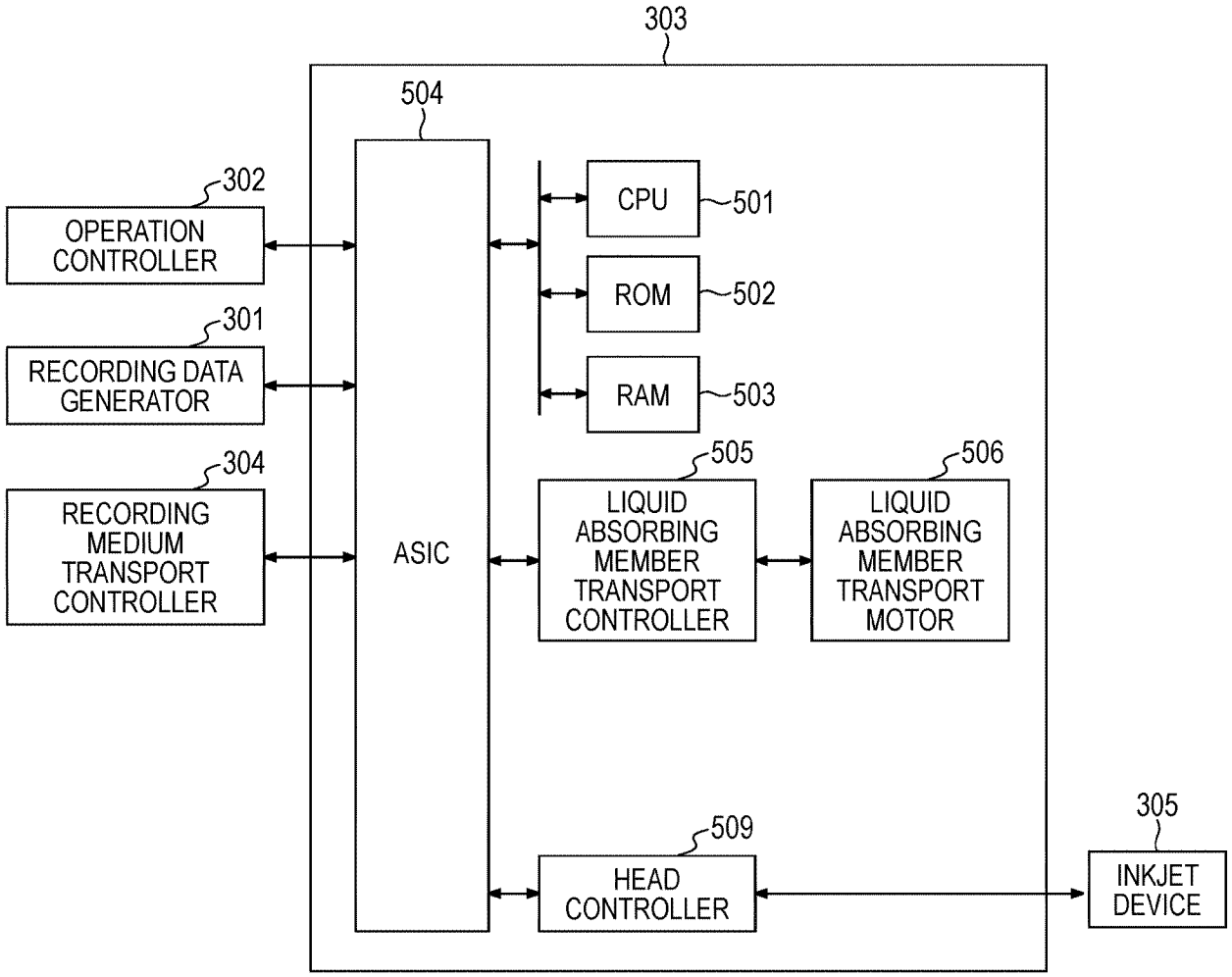
FIG. 5 is a block diagram of a printer controller in the direct writing-type inkjet recording apparatus illustrated in FIG. 2.

FIG. 5 is a block diagram of a printer controller in the direct writing-type inkjet recording apparatus of FIG. 2. This block diagram is equivalent to the block diagram of the printer controller in the transfer-type inkjet recording apparatus in FIG. 4 except that the transfer member drive controller 407 and the transfer member drive motor 408 are absent.

In other words, reference numeral 501 denotes CPU which controls the whole printer. Reference numeral 502 denotes ROM which stores the control program of the CPU 501. Reference numeral 503 denotes RAM which executes the program. Reference numeral 504 denotes an ASIC having an embedded network controller, serial IF controller, controller for head data generation, motor controller and the like. Reference numeral 505 denotes a liquid absorbing member transport controller for driving liquid absorbing member transport motor 506. The liquid absorbing member transport controller is command-controlled from the ASIC 504 via serial IF. Reference numeral 509 denotes a head controller which performs the final ejection data generation, driving voltage generation, etc. of the inkjet device 305.

[Inkjet Head]

Hereinafter, the inkjet head of the present embodiment will be described with reference to the drawings. However, the description below does not limit the scope of the present invention. As one example, in the present embodiment, a thermal inkjet system is adopted that ejects an ink by generating air bubbles using a heater element which is an energy generation element, but inkjet heads can be also applied in which a Piezo system or various other systems are adopted. The present embodiment is an inkjet recording apparatus which has such a form as to circulate ink between a tank and an inkjet head but may have another form.

(Basic Configuration)

In the present embodiment, the number of ejection port rows that can be used per color is 20. Therefore, recording data is appropriately distributed to a plurality of discharge port rows for recording. As a result, high-speed recording is achieved. Even if an ink-eject disabled ejection port is present, reliability is improved by compensating for the ejection port by an ejection port of a different row located at a position corresponding to the transport direction of an ejection receiving medium. Thus, this configuration is suitable for commercial printing, etc.

(Description of Circulation Route)

Figure 6:
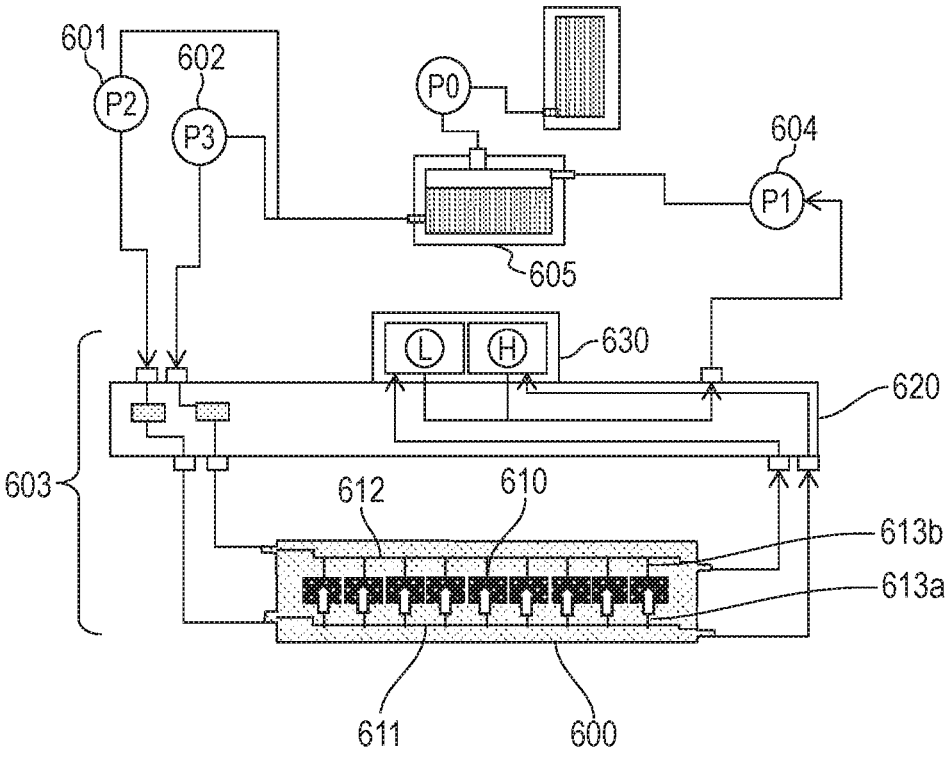
FIG. 6 is a schematic view illustrating a circulation route applied to an inkjet recording apparatus in one embodiment of the present invention.

FIG. 6 is a schematic view illustrating a circulation route applied to the inkjet recording apparatus of the present embodiment. Both of two pressure adjustment mechanisms constituting negative pressure control unit 630 are mechanisms which control pressure upstream of the negative pressure control unit 630 within a given range of fluctuation centered on the desired set pressure (mechanical components having the same action as that of a so-called "back-pressure regulator"). A second circulation pump 604 acts as a negative pressure source that reduces pressure downstream of the negative pressure control unit 630. First circulation pump (high-pressure side) 601 and first circulation pump (low-pressure side) 602 are disposed upstream of the inkjet head 603, and the negative pressure control unit 630 is disposed downstream of the inkjet head 603.

The negative pressure control unit 630 works to stabilize pressure fluctuation upstream thereof (i.e., on the ink ejection unit 600 side) within a given range centered on predetermined set pressure, even if a flow rate fluctuates due to change in recording duty in performing recording by the inkjet head 603. As illustrated in FIG. 6, a region downstream of the negative pressure control unit 630 can be pressurized by the second circulation pump 604 via ink supply unit 620. This can suppress the influence of hydraulic head pressure of buffer tank 605 on the inkjet head 603 and can therefore expand the range of choice of the layout of the buffer tank 605 in the inkjet recording apparatus. Instead of the second circulation pump 604, for example, a water head tank established with predetermined water head difference from the negative pressure control unit 630 is also applicable.

As illustrated in FIG. 6, the negative pressure control unit 630 includes two pressure adjustment mechanisms respectively set to control pressures different from each other. Of these two negative pressure adjustment mechanisms, a high-pressure side (indicated by H in FIG. 6) and a low-pressure side (indicated by L in FIG. 6) are connected to common supply flow channel 611 and common recovery flow channel 612, respectively, within the ink ejection unit 600 by way of the inside of the ink supply unit 620. The two negative pressure adjustment mechanisms set the pressure of the common supply flow channel 611 to be relatively higher than that of the common recovery flow channel 612 so that ink flows from the common supply flow channel 611 into individual supply flow channel 613*b* and the common recovery flow channel 612 via individual supply flow channel 613*a* and the internal flow channel of each recording element substrate 610 (arrows of FIG. 6).

(Description of Configuration of Inkjet Head)

Figure 7A:
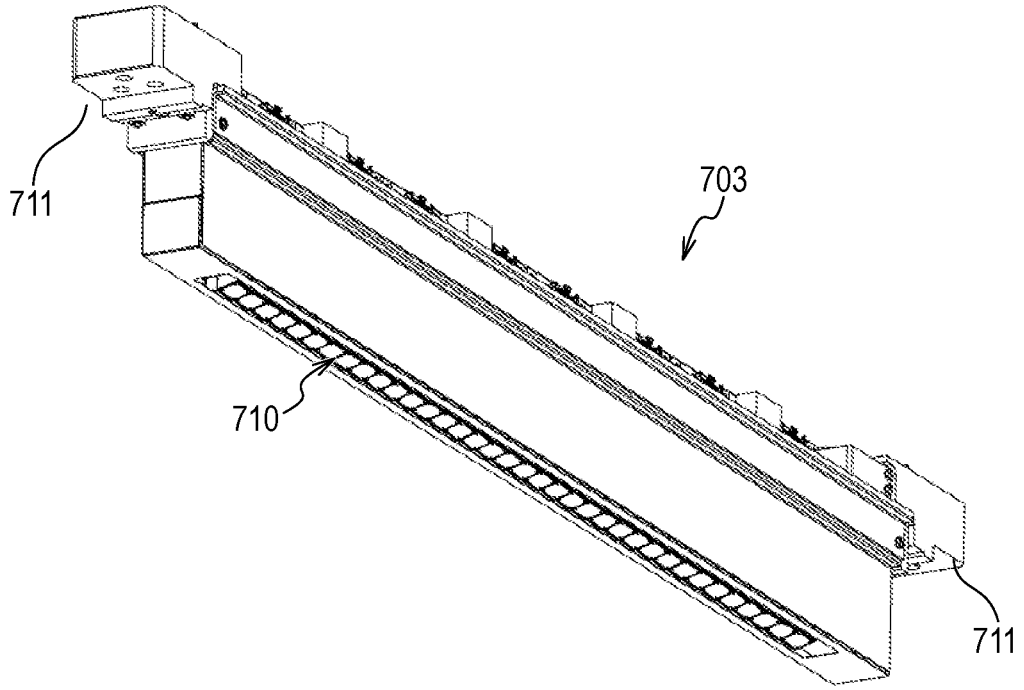
FIGS. 7A and 7B are perspective views illustrating an example of the configuration of an inkjet head in one embodiment of the present invention.
Figure 7B:
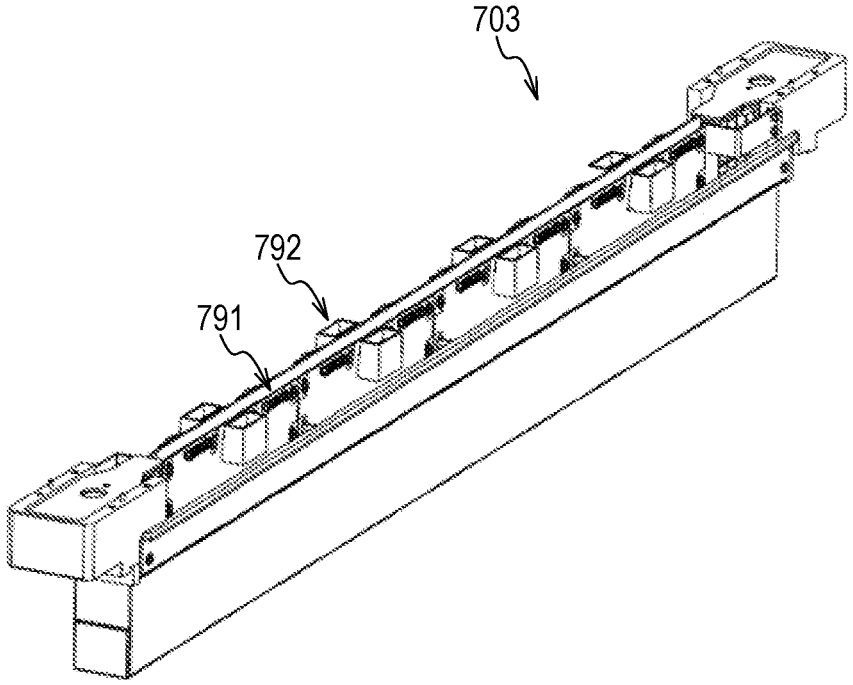

A configuration of the inkjet head according to the present embodiment will be described below. FIG. 7A and FIG. 7B are perspective views of the inkjet head 703 according to the present embodiment. The inkjet head 703 is a line-type inkjet recording head capable of recording using an ink of one color, including a plurality of recording element substrates 710 linearly arranged in the longitudinal direction of the inkjet head 703. The inkjet head 703 includes ink connecting parts 711, signal input terminals 791 and power supply terminals 792. In the inkjet head 703, the signal input terminals 791 and the power supply terminals 792 are disposed on both sides of the inkjet head 703. This is because of reducing voltage drop or signal transmission delay in a wiring part disposed in the recording element substrate 710.

Figure 8:
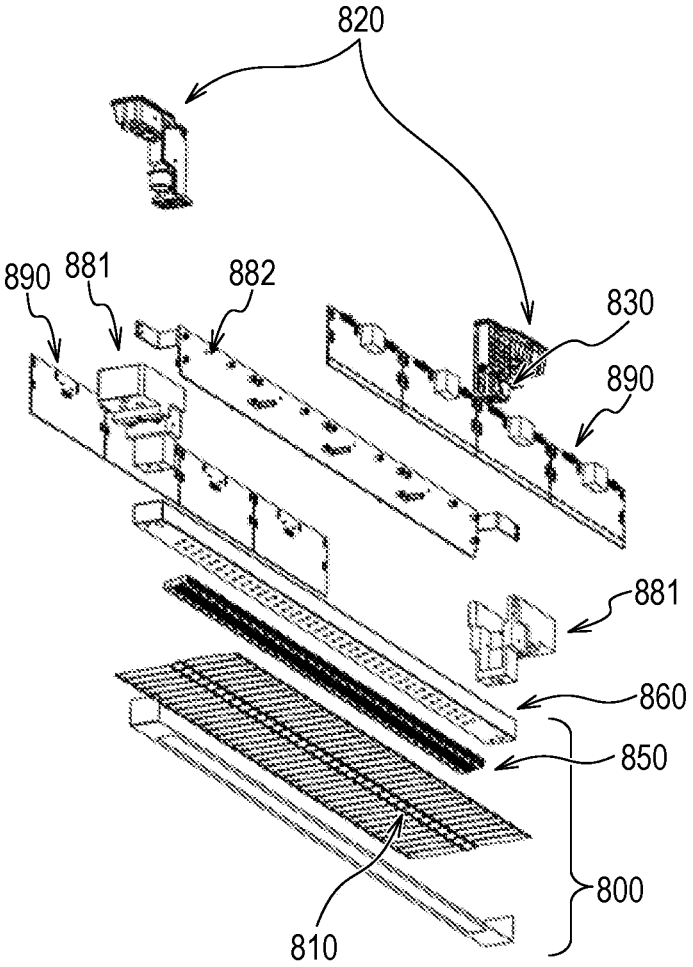
FIG. 8 is an exploded perspective view illustrating an example of the configuration of an inkjet head in one embodiment of the present invention.

FIG. 8 is a perspective exploded view of the inkjet head and illustrates each component or unit constituting the inkjet head on a function basis. The rigidity of the inkjet head of the present embodiment is ensured by second flow channel member 860 included in ink ejection unit 800. In the present embodiment, ink ejection unit supporting parts 881 are connected to both ends of the second flow channel member 860. This ink ejection unit 800 is mechanically attached to a carriage of the inkjet recording apparatus to perform the positioning of the inkjet head. Ink supply units 820 including negative pressure control units 830 and electric wiring substrates 890 attached to electric wiring substrate supporting part 882 are attached to the ink ejection unit supporting part 881. Filters (not shown) are respectively embedded in two ink supply units 820. Two negative pressure control units 830 are set to respectively control pressure as different relatively high and low negative pressures. When the high-pressure side and low-pressure side negative pressure control units 830 are respectively disposed at both ends of the inkjet head as illustrated in FIG. 8, ink flows in common supply flow channel and common recovery flow channel which extend in the longitudinal direction of the inkjet head are opposed to each other. This promotes the heat exchange between the common supply flow channel and the common recovery flow channel and reduces the difference between the internal temperatures of these two common flow channels. Therefore, a plurality of recording element substrates disposed along the common flow channels rarely differ in temperature and are less likely to cause uneven recording ascribable to difference in temperature.

Next, the flow channel member of the ink ejection unit 800 will be described in detail. As illustrated in FIG. 8, the flow channel member is a laminate of first flow channel member 850 and second flow channel member 860 and distributes an ink supplied from ink supply unit 820 to each ejection module 810. The flow channel member also functions as a flow channel member for bringing back an ink refluxed from the ejection module 810 to the ink supply unit 820. The second flow channel member 860 of the flow channel member is a flow channel member having a common supply flow channel and a common recovery flow channel in the inside, and has a function of being mainly responsible for the rigidity of the inkjet head. Therefore, a material having sufficient corrosion resistance to an ink and high mechanical strength can be used as a material of the second flow channel member 860. Specifically, SUS, Ti, alumina or the like can be used.

Figure 9A:
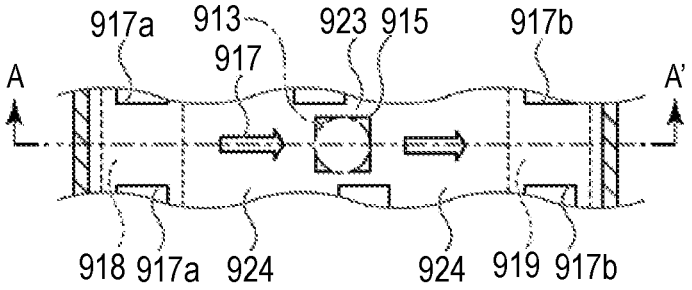
FIGS. 9A, 9B and 9C are figures illustrating an example of the structure of the ejection port of an inkjet head and its neighboring ink flow channel in one embodiment of the present invention.
Figure 9B:
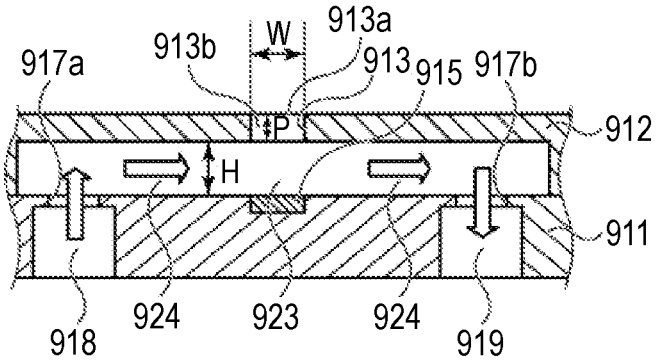
Figure 9C:
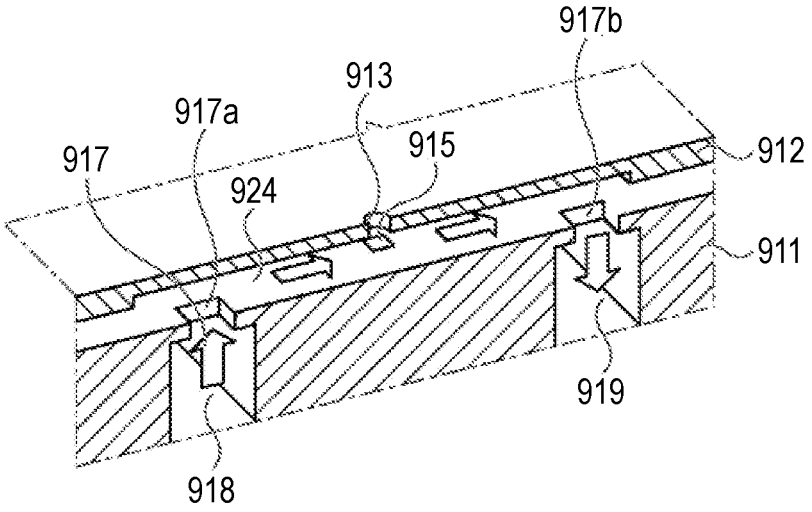

Next, the structure of the ejection port and the vicinity thereof in the inkjet head according to the present embodiment described above will be described. Each of FIGS. 9A to 9C is a diagram illustrating the structures of an ejection port and its neighboring ink flow channel in the inkjet head according to the present embodiment. FIG. 9A is a plane view of the ink flow channel, etc. viewed from the side where ink is ejected. FIG. 9B illustrates the cross section taken along the A-A' line in FIG. 9A. FIG. 9C is a perspective view of the cross section taken along the A-A' line of FIG. 9A.

As illustrated in FIGS. 9A to 9C, the ink circulation mentioned above with reference to FIG. 6, etc. generates ink flow 917 in pressure chamber 923 having energy generation element 915 on substrate 911 of the inkjet head provided in the inside, and in flow channels 924 upstream and downstream thereof. Specifically, by differential pressure causing ink circulation, ink supplied from ink supply channel (supply flow channel) 918 via supply port 917*a* of the substrate 911 flows through the flow channel 924, the pressure chamber 923 and the flow channel 924 and arrives at ink recovery channel (outflow channel) 919 via recovery port 917*b*.

Along with the ink flow mentioned above, the space from the energy generation element 915 to the discharge port 913 above the element, which discharge the ink therethrough, is filled with ink when ejection is not performed, and ink meniscus (ink interface 913*a*) is formed in the vicinity of an end in the ejection direction of the ejection port 913. Incidentally, in FIG. 9B, this ink interface is indicated by straight line (plane) for simplification. However, its shape depends on a member forming the wall of the ejection port 913, and ink surface tensions, and is usually a concave or convex curve (curved surface). In this state having meniscus, a thermoelectric conversion element (heater) serving as the energy generation element 915 is driven, and air bubbles are generated in ink by utilizing heat thus generated so that the ink can be ejected from the ejection port 913. In the present embodiment, an example using a heater as the energy generation element will be described. However, the present invention is not limited by this example, and, for example, various energy generation elements such as piezoelectric elements are applicable. In the present embodiment, the flow rate of ink that flows in the flow channel 924 is, for example, 0.1 to 100 mm/s, which can relatively decrease the influence of ejection operation with ink flowing on landing accuracy, etc.

As mentioned above, ink ejection operation is performed while the ink is circulated in the pressure chamber and the flow channel between the ejection port and the energy generation element in the inkjet head. Thereby, ink that has been thickened and has changed its color material concentration due to the evaporation of water, etc. from the ink by heat resulting from ejection operation, heat caused by the temperature control of a recording element substrate, or heat from an external environment in the vicinity of the ejection port can be ejected, and the system can be replenished with fresh ink. As a result, ejection failure ascribable to ink thickening or image color irregularity ascribable to change in color material concentration can be suppressed.

(Relationship Among P, W and H)

For the inkjet head according to the present embodiment, the relationship among height H of the flow channel 924, thickness P of the orifice plate (flow channel forming member 912) and length (diameter) W of the ejection port can be defined as described below.

In FIG. 9B, the upstream height of the flow channel 924 at the lower end (communicating part between a ejection port site and the flow channel) of a portion corresponding to the orifice plate thickness P of the ejection port 913 (hereinafter, referred to as ejection port site 913*b*) is represented by H. The length of the ejection port site 913*b* is represented by P. Furthermore, the length of the ejection port site 913*b* in the ink flow direction within the flow channel 924 is represented by W. The inkjet head according to the present embodiment can have H of 3 to 30 μm, P of 3 to 30 μm and W of 6 to 30 μm.

Figure 10:
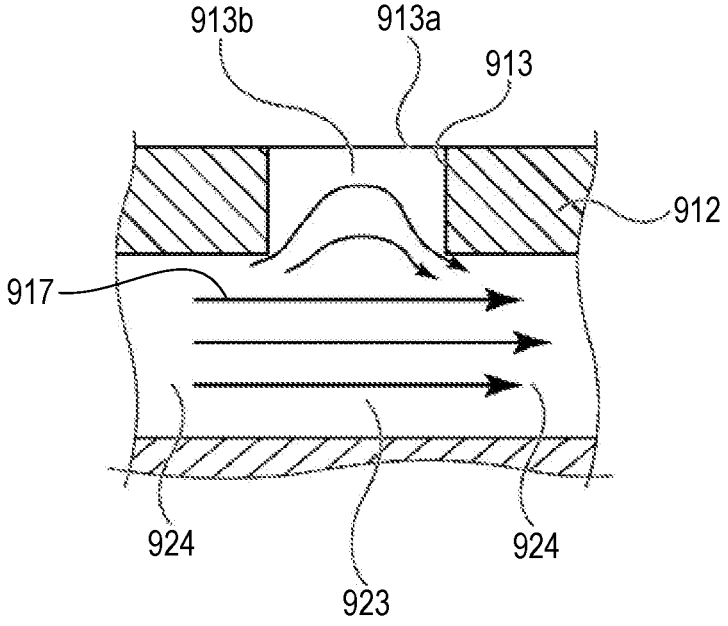
FIG. 10 is a sectional view illustrating an example of the flow of an ink flow in an inkjet head in one embodiment of the present invention.

The inkjet head according to the present embodiment can have the following configuration in order to suppress thickening of the ink due to evaporation of the ink from the ejection port 913, and the like. FIG. 10 is a diagram illustrating the behavior of ink flow 917 in the ejection port 913, the ejection port site 913*b*, and the flow channel 924 when the ink flow 917 of the ink flowing within the flow channel 924 and the pressure chamber 923 of the inkjet head is in a steady state. Incidentally, in FIG. 10, the lengths of the arrows do not mean the magnitude of an ink flow rate. In the inkjet head illustrated in FIG. 10, the height H of the flow channel 924 is 14 μm, the length P of the ejection port site 913*b* is 10 μm, and the length (diameter) W of the ejection port is 17 μm. FIG. 10 illustrates the flow of ink that flows at a flow rate of $1.26\times10^{-4}$ ml/min from the ink supply channel 918 to the flow channel 924 at this time.

In the present embodiment, the height H (μm) of the flow channel 924, the length P (μm) of the ejection port site 913*b*, and the length W (μm) in the ink flow direction of the ejection port site 913*b* have a relationship that satisfies the following expression (1).

$$H^{-0.34}\times P^{-0.66}\times W>1.5 \quad (1)$$

When the inkjet head according to the present embodiment satisfies the above described expression (1), as illustrated in FIG. 10, the ink flow 917 within the flow channel 24 enters into the ejection port site 913*b*, arrives at a position of at least half the length P of the ejection port site 913*b*, and then returns to the flow channel 924 again. The ink that has returned to the flow channel 924 flows to the common recovery flow channel mentioned above via ink recovery channel 919. Specifically, at least a portion of the ink flow 917 arrives at a position of ½ or more of the ejection port site 913*b* in a direction from the pressure chamber 923 toward ink interface 913*a*, and then returns to the flow channel 924. This flow can suppress ink thickening in many regions within the ejection port site 913*b*. The generation of such an ink flow within the inkjet head enables not only the ink of the flow channel 924 but also the ink of the ejection port site 913*b* to flow out to the flow channel 924. As a result, ink thickening and increase in ink color material concentration can be suppressed.

Figure 11:
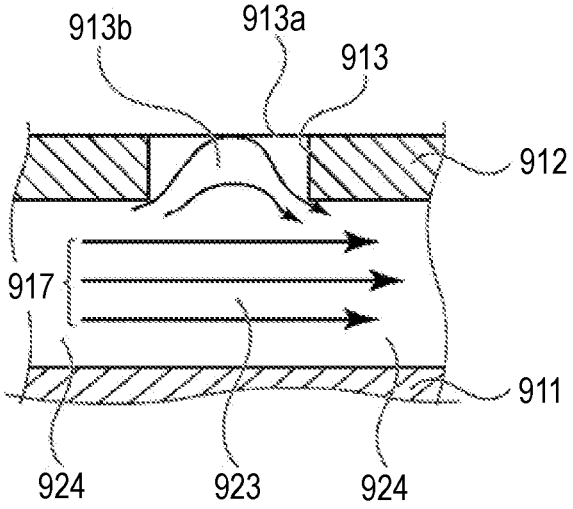
FIG. 11 is a sectional view illustrating an example of the flow of an ink flow in an inkjet head in one embodiment of the present invention.

Furthermore, the inkjet head according to the present embodiment can have the following configuration in order to further reduce the influence of the ink thickening due to evaporation of the liquid component from the ejection port, and of the like. FIG. 11 is a diagram illustrating the behavior of ink flow 917 in the ejection port 913, the ejection port site 913*b*, and the flow channel 924 when the ink flow 917 of the ink flowing within the inkjet head is in a steady state, as in FIG. 10. Incidentally, in FIG. 11, the lengths of the arrows do not correspond to the magnitude of a flow rate and are indicated by given length, regardless of the magnitude of a flow rate. FIG. 11 illustrates the flow of ink that flows at a flow rate of $1.26\times10^{-4}$ ml/min into the flow channel 924 from the ink supply channel, in the inkjet head having H of 14 μm, P of 5 μm and W of 12.4 μm.

In the present embodiment, the height H of the flow channel 924, the length P of the ejection port site 913*b*, and the length W in the ink flow direction of the ejection port site 913*b* have a relationship that satisfies the following expression (2).

$$H^{-0.34}\times P^{-0.66}\times W>1.7 \quad (2)$$

This can further prevent ink having a changed color material concentration or an increased viscosity due to the evaporation of the ink from the ejection port from accumulating in the vicinity of the ink interface 913*a* of the ejection port site 913*b*, as compared with the above described embodiment. Specifically, in the present embodiment, as illustrated in FIG. 11, the ink flow 917 flowing within the flow channel 924 enters into the ejection port site 913*b*, arrives at the vicinity of the ink interface 913*a* (meniscus position), and then returns to the flow channel 924 through the ejection port site 913*b* again. The ink that has returned to the flow channel 924 flows to the common recovery flow channel mentioned above via ink recovery channel 919. Such an ink flow enables not only the ink within the ejection port site 913*b* susceptible to evaporation but also the ink in the vicinity of the ink interface 913*a* particularly remarkably influenced by evaporation to flow out to the flow channel 924 without accumulating in the inside of the ejection port site 913*b*. As a result, ink at a site particularly susceptible to the evaporation of water, etc. from the ink, in the vicinity of the ejection port can flow out thereof without accumulation. Thus, ink thickening and increase in ink color material concentration can be suppressed. The present embodiment can suppress increase in viscosity in at least a portion of the ink interface 913*a* and can therefore further reduce the influence of change in ejection rate, etc. on ejection, as compared with the case where viscosity is increased throughout the ink interface 913*a*.

The ink flow 917 according to the present embodiment has a velocity component of the ink flow direction (direction from the left toward the right in FIG. 11) (hereinafter, this velocity component is referred to as a positive velocity component) within the flow channel 924 at least in a central portion (central portion of the ejection port) in the vicinity of the ink interface 913*a*. Incidentally, in the present specification, the mode of ink flow 917 having a positive velocity component at least in the central portion in the vicinity of the ink interface 913*a* is referred to as "flow mode A". In addition, the mode of a flow having a negative velocity component of a direction opposite to that of the positive velocity component in the central portion of the ink interface 913*a* is referred to as "flow mode B".

According to the present invention, an inkjet recording method and an inkjet recording apparatus can be provided which can suppress deterioration in image quality and image stability, even when ink in a pressure chamber of an inkjet head is circulated between the pressure chamber and the outside of the pressure chamber.

EXAMPLES

Hereinafter, the present embodiment will be described in more detail with reference to Examples and Comparative Examples. The present invention is not limited by Examples described below by any means without departing from the spirit of the present invention. In the description of Examples below, the term "part" is based on mass unless otherwise described.

Example 1

<Preparation of Reaction Solution>

Each of the following components were mixed and thoroughly stirred, and then pressure-filtered through a cellulose acetate filter (made by Advantech Corporation) having a pore size of 3.0 μm to prepare a reaction solution.

Levulinic acid: 40.0 parts

Glycerin: 5.0 parts

Megafac F 444: 1.0 part (trade name, surfactant made by DIC Corporation)

Ion-exchange water: 54.0 parts

<Preparation of Aqueous Dispersion Liquid of Resin Particle 1>

Into a four-necked flask equipped with a stirrer, a reflux condenser and a nitrogen gas introducing tube, 18.0 parts of butyl methacrylate, 2.0 parts of a polymerization initiator (2,2'-azobis(2-methylbutyronitrile)), and 2.0 parts of n-hexadecane were charged. Nitrogen gas was introduced into this reaction system and stirred this reaction system for 0.5 hours. To this flask, 78.0 parts of 6.0% by mass of an aqueous solution of an emulsifier (trade name: NIKKOLBC 15, made by Nikko Chemicals Co., Ltd.) were added dropwise and stirred for 0.5 hours. Subsequently, the mixture was irradiated with ultrasound in an ultrasound irradiation machine for 3 hours to be emulsified. Then, a polymerization reaction was performed at 80° C. for 4 hours in a nitrogen atmosphere. The reaction system was cooled to 25° C., then the components were filtered, and an appropriate amount of pure water was added to prepare an aqueous dispersion liquid of a resin particle 1 of which the content of the resin particle 1 (solid content) was 20.0% by mass.

<Preparation of Aqueous Solution of Resin 1>

A styrene-ethyl acrylate-acrylic acid copolymer (resin 1) was prepared that had an acid value of 150 mg KOH/g and a weight average molecular weight of 8,000. A resin 1 in an amount of 20.0 parts was neutralized with potassium hydroxide equimolar to its acid value, and an appropriate amount of pure water was added to prepare an aqueous solution of a resin particle 1 of which the content of the resin 1 (solid content) was 20.0% by mass.

<Preparation of Pigment Dispersion Liquid K>

Pigment (carbon black) in an amount of 10.0 parts, 15.0 parts of an aqueous solution of the resin 1, and 75.0 parts of pure water were mixed. This mixture and 200 parts of zirconia beads having a diameter of 0.3 mm were placed in a batch type vertical sand mill (made by Aimex Corporation), and the mixture was dispersed for 5 hours while having been cooled with water. Then, the coarse particles were removed by centrifugation, and the remaining liquid was pressure-filtered through a cellulose acetate filter (made by Advantech Corporation) having a pore size of 3.0 μm to prepare a pigment dispersion liquid K of which the content of the pigment was 10.0% by mass and the content of the resin 1 that was a resin dispersant was 3.0% by mass.

<Preparation of Ink>

Each of the components shown in the following Table 1 were mixed and thoroughly stirred, and then the mixture was pressure-filtered through a cellulose acetate filter (made by Advantech Corporation) having a pore size of 3.0 μm to prepare black ink. For information, Acetylenol E100 (trade name) is a surfactant made by Kawaken Fine Chemicals Co., Ltd.

TABLE 1

| | Part by mass |
|---|---|
| Pigment dispersion liquid K | 20.0 |
| Aqueous dispersion liquid of resin particle 1 | 50.0 |
| Aqueous solution of resin 1 | 5.0 |
| Glycerin | 5.0 |
| Acetylenol E100 | 0.5 |
| Pure water | 19.5 |

<Preparation of Transfer Member>

A woven fabric and a porous layer consisting of an acrylonitrile/butadiene rubber were layered, a silicone rubber mixed with hollow particles was further layered thereon, and the product was vulcanized. Next, a mixture was prepared by mixing 7 parts of a carbon masterbatch which was a highly concentrated coloring material for silicone rubber to 100 parts of the silicone rubber and was layered on the surface of the above described porous layer. The product was vulcanized. Next, glycidoxypropyltriethoxysilane and methyltriethoxysilane were mixed and heated to reflux in an aqueous solvent for 24 hours or longer, and a solution was obtained which contained a condensate obtained by condensing an organosilicon compound. This solution was diluted to 12% by mass with methyl isobutyl ketone, 5% by mass of a photocationic polymerization initiator SP 150 (trade name, made by ADEKA Corporation) was added to the solid content, and the mixture was diluted with methyl isobutyl ketone to prepare a coating liquid. The coating liquid was applied onto the above described silicone rubber to form a film, which was subjected to plasma treatment. Next, the film was irradiated with a UV lamp to be exposed to light, and then was heated at 150° C. for 2 hours to be cured. Thereby, the surface layer was formed, and a transfer member was obtained.

<Inkjet Recording Apparatus and Image Formation>

An image was formed with the use of the transfer-type inkjet recording apparatus illustrated in FIG. 1. For the transfer member 101, the transfer member prepared by the above described method was used. The transfer member 101 is fixed to the surface of the supporting member 102.

The above described reaction solution was applied onto the transfer member 101 by a reaction solution application apparatus 103. Then, the above described ink was applied onto the transfer member 101 by an ink application apparatus 104 to form an ink image. As the ink application apparatus 104, the inkjet head illustrated in FIGS. 7A and 7B was used. The inkjet head includes a recording element substrate that has an energy generation element, a pressure chamber having the element inside, and an ejection port. Ink in the pressure chamber is circulated between the pressure chamber and the outside thereof. As a pattern of the ink image, a 100% solid pattern was used in which a solid image of which the recording duty was 100% was formed in an area of 1 cm×1 cm. Incidentally, in the present transfer-type inkjet recording apparatus, a condition for applying one droplet of 4 ng per ink droplet onto a unit area of 1/1,200 inch×1/1,200 inch at a resolution of 1,200 dpi×1,200 dpi is defined to be that the recording duty is 100%. In addition, the ink and the reaction solution were applied so that the ratio of the amount of the ink to the amount of the reaction solution (amount of ink: amount of reaction solution) in the image region was 5:1.

Next, a liquid absorbing member 105*a* having a porous body was brought into contact with the above described ink image formed on the transfer member 101, and absorbed and removed the liquid component from the ink image. The laminate was used for the liquid absorbing member 105*a*, in which the porous body that was a stretched film consisting of PTFE and had an average pore size of 0.4 μm and a thickness of 100 μm was laminated with a nonwoven fabric (trade name: HOP, made by Hirose Paper Mfg. Co., Ltd.) by thermal lamination. The Gurley value of the liquid absorbing member 105*a* was 5 seconds. This liquid absorbing member was infiltrated by dipping with a treatment solution consisting of 95 parts of ethanol and 5 parts of water, before being brought into contact with the ink image. Then, the treatment solution was replaced with a solution consisting of 100 parts of water. The resulting liquid absorbing member was used in liquid removal. The pressure at which the liquid absorbing member 105*a* came in contact with the ink image was set at 2.9 N/cm$^2$ (0.3 kgf/cm$^2$) or larger. Here, the rate of removal of the water-soluble organic solvent having a boiling point of 110° C. or higher contained in the above described ink image, resulting from the contact of the liquid absorbing member 105*a* with the above described ink image was measured. The removal rate was obtained by measuring the contents of the above described water-soluble organic solvent contained in the above described ink image, from the absorbance of the infrared absorption spectrum of the above described ink image before and after removal of the liquid component, and calculating the rate of change.

Then, the ink image after the liquid removal was irradiated with infrared rays, and thereby the heating temperature T of the ink image was controlled to 150° C. Next, a recording medium 108 was brought into contact with the ink image, and the ink image after the liquid removal and the recording medium 108 were sandwiched and pressed by the supporting member 102 and the pressing member 106 for transfer. Thereby, the ink image after the liquid removal was transferred onto the recording medium 108 to form the image. Coated paper (trade name: Aurora Coat, manufactured by Nippon Paper Industries Co., Ltd., basis weight; 73.5 g/m2) was used as a recording medium 108.

<Image Quality Evaluation>

An ink image before the liquid removal formed on the transfer body was observed with an optical microscope, and the image area was determined to be a basic image area. Next, the final image formed on the recording medium 108 was observed with an optical microscope, the area was calculated, and the image quality was evaluated based on the rate of change shown by the following expression, according to the following criteria. The results are shown in Table 3.

$$\text{Rate of change (\%)}=[(\text{basic image area}-\text{final image area})/(\text{basic image area})]\times 100$$

AA: The rate of change is less than 0.5%.

A: The rate of change is 0.5% or more and less than 1.0%.

B: The rate of change is 1.0% or more and less than 3.0%.

C: The rate of change is 3.0% or more.

<Image Stability Evaluation>

A 60-degree optical glossiness of the final image formed on the recording medium 108 was measured with a glossmeter (trade name: IG-331, made by Horiba Ltd.), and the rate of change with the glossiness after 1 week was calculated. The image stability was evaluated according to the following criteria by regarding the 100-change rate as a value showing the stability of the glossiness. The results are shown in Table 3.

AA: The stability of the glossiness is 95% or more.

A: The stability of the glossiness is 90% or more and less than 95%.

B: The stability of the glossiness is 80% or more and less than 90%.

C: The stability of glossiness is less than 80%.

Examples 2 to 6 and Comparative Examples 1 to 3

The presence/absence of ink circulation, a method for removing the liquid component from the ink image, a type and a content of water-soluble organic solvent (high boiling point) contained in the ink, a heating temperature T, a material of the porous body of the liquid absorbing member 105*a*, and the inkjet recording system were changed as shown in Table 2. Except those, images were formed and evaluated as in Example 1. The results are shown in Table 3. Incidentally, in Example 5, a nonwoven fabric consisting of polypropylene was used as the porous body of the liquid absorbing member 105*a*. In addition, in Example 6, a nonwoven fabric consisting of polyvinylidene fluoride (PVDF) was used as the porous body of the liquid absorbing member 105*a*. In addition, the inkjet head used in Comparative Example 1 had a configuration in which the ink in the pressure chamber communicated with the outside only through the ejection port, and the ink was not circulated. In addition, in Comparative Example 2, instead of removing the liquid component by the liquid absorbing member 105*a*, the ink image was dried with hot air at 100° C. Incidentally, the boiling point of glycerin used as the water-soluble organic solvent in the ink is 290° C., the boiling point of ethylene glycol monomethyl ether is 124° C., and the boiling point of ethanol is 78° C.

This application claims the benefit of Japanese Patent Application No. 2017-131375, filed Jul. 4, 2017, which is hereby incorporated by reference herein in its entirety.

TABLE 2

| | Ink circulation | Method for removing liquid component | Water-soluble organic solvent in ink: Type | Water-soluble organic solvent in ink: Content (% by mass) | Content of water-soluble organic solvent before liquid component removal (% by mass) | Content of water-soluble organic solvent after liquid component removal (% by mass) | Removal rate (% by mass) | Heating temperature T (° C.) | Material of porous body | System |
|---|---|---|---|---|---|---|---|---|---|---|
| Example 1 | Present | Contact with porous body | Glycerin | 5 | 6 | 1.5 | 75 | 150 | PTFE | Transfer-type |
| Example 2 | Present | Contact with porous body | Glycerin | 30 | 31 | 3 | 90 | 150 | PTFE | Transfer-type |
| Example 3 | Present | Contact with porous body | Ethylene glycol mono-methyl ether | 10 | 11 | 2 | 82 | 110 | PTFE | Transfer-type |
| Example 4 | Present | Contact with porous body | Glycerin | 10 | 11 | 0.1 | 99 | 300 | PTFE | Transfer-type |
| Example 5 | Present | Contact with porous body | Glycerin | 10 | 11 | 4 | 64 | 150 | Polypro-pylene | Transfer-type |
| Example 6 | Present | Contact with porous body | Glycerin | 10 | 11 | 3.5 | 68 | 150 | PVDF | Direct writing-type |
| Compar-ative Example 1 | Absent | Contact with porous body | Glycerin | 10 | 11 | 2 | 82 | 150 | PTFE | Transfer-type |
| Compar-ative Example 2 | Present | Hot air drying | Glycerin | 10 | 11 | 10 | 9 | 150 | PTFE | Transfer-type |
| Compar-ative Example 3 | Present | Contact with porous body | Ethanol | 10 | 11 | 1 | 91 | 150 | PTFE | Transfer-type |

TABLE 3

| | Image quality evaluation | Image stability evaluation |
|---|---|---|
| Example 1 | AA | AA |
| Example 2 | AA | AA |
| Example 3 | A | AA |
| Example 4 | B | AA |
| Example 5 | A | A |
| Example 6 | AA | AA |
| Comparative Example 1 | C | AA |
| Comparative Example 2 | AA | C |
| Comparative Example 3 | C | AA |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An inkjet recording method comprising:

forming an ink image by ejecting ink on an ejection receiving medium by an inkjet head comprising a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber; and removing at least a portion of a liquid component from the ink image by bringing a liquid absorbing member into contact with the ink image, wherein the ink contains 5% by mass or more to 30% by mass or less of a water-soluble organic solvent having a boiling point of 110° C. or more, and 50% by mass or more of the water-soluble organic solvent contained in the ink image and having a boiling point of 110° C. or more is removed from the ink image in the removal of at least a portion of a liquid component from the ink image.

2. The inkjet recording method according to claim 1, further comprising heating the ink image to T° C., wherein the boiling point of the water-soluble organic solvent contained in the ink image is higher than T° C.

3. The inkjet recording method according to claim 1, wherein the liquid absorbing member has a porous body which comes into contact with the ink image and which contains a fluorine compound.

4. The inkjet recording method according to claim 1, wherein the ejection receiving medium is a transfer member, and the inkjet recording method further comprises bringing a recording medium into contact with the transfer member to transfer the ink image from which the liquid component is removed to the recording medium.

5. The inkjet recording method according to claim 1, wherein the ejection receiving medium is a recording medium.

6. An inkjet recording apparatus comprising:

an ejection receiving medium;

an ink application apparatus having an inkjet head comprising a recording element substrate having an element which generates energy that is utilized for ejecting ink, a pressure chamber which has the element in the inside, and an ejection port which ejects ink, wherein the ink is circulated between the inside of the pressure chamber and the outside of the pressure chamber, and an ink image is formed by ejecting the ink on the ejection receiving medium; and a liquid absorption apparatus having a liquid absorbing member which removes at least a portion of a liquid component from the ink image by coming into contact with the ink image, wherein the ink contains 5% by mass or more to 30% by mass or less of a water-soluble organic solvent having a boiling point of 110° C. or more, and 50% by mass or more of the water-soluble organic solvent contained in the ink image and having a boiling point of 110° C. or more is removed from the ink image by bringing the liquid absorbing member into contact with the ink image.

7. The inkjet recording apparatus according to claim 6, further comprising a heating apparatus which heats the ink image to T° C., wherein the boiling point of the water-soluble organic solvent contained in the ink image is higher than T° C.

8. The inkjet recording apparatus according to claim 6, wherein the liquid absorbing member has a porous body which comes into contact with the ink image and which contains a fluorine compound.

9. The inkjet recording apparatus according to claim 6, wherein the ejection receiving medium is a transfer member, and the inkjet recording apparatus further comprises a pressing member for transfer which brings a recording medium into contact with the transfer member to transfer the ink image from which the liquid component is removed to the recording medium.

10. The inkjet recording apparatus according to claim 6, wherein the ejection receiving medium is a recording medium.

* * * * *